US008355016B2

(12) United States Patent
Odawara et al.

(10) Patent No.: US 8,355,016 B2
(45) Date of Patent: Jan. 15, 2013

(54) DISPLAY DEVICE, ELECTRONIC DEVICE, AND DRIVING METHOD

(75) Inventors: Rie Odawara, Kyoto (JP); Shinya Ono, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/424,854

(22) Filed: Mar. 20, 2012

(65) Prior Publication Data

US 2012/0176362 A1 Jul. 12, 2012

Related U.S. Application Data

(60) Division of application No. 12/823,234, filed on Jun. 25, 2010, now Pat. No. 8,164,546, which is a continuation of application No. PCT/JP2008/004022, filed on Dec. 26, 2008.

(30) Foreign Application Priority Data

Jan. 7, 2008 (JP) ..... 2008-000779

(51) Int. Cl.
*G09G 5/00* (2006.01)

(52) U.S. Cl. ..... 345/212; 345/76; 345/211

(58) Field of Classification Search ..... 345/76–84, 345/90–100, 204–215
See application file for complete search history.

(56) References Cited

U.S. PATENT DOCUMENTS 6,989,826 B2 * 1/2006 Kasai ..... 345/204
7,466,311 B2 * 12/2008 Kasai ..... 345/204
8,089,477 B2 1/2012 Shirouzu et al.
2004/0108518 A1 6/2004 Jo
2006/0022907 A1 2/2006 Uchino et al.
2006/0119549 A1 6/2006 Maekawa
2007/0035487 A1 2/2007 Ryu et al.
2008/0030438 A1 2/2008 Marx et al.
2008/0111773 A1 5/2008 Tsuge
2008/0150845 A1 6/2008 Ishii et al.
2008/0180365 A1 7/2008 Ozaki
2008/0218452 A1 9/2008 Kohno et al.
2008/0218499 A1 9/2008 Kohno et al.
2010/0245331 A1 9/2010 Shirouzu et al.
(Continued)

FOREIGN PATENT DOCUMENTS

JP 2003-140613 5/2003
(Continued)

OTHER PUBLICATIONS

Arinobu Kanegae et al., "Pixel Circuit and Display Appratus", U.S. Appl. No. 12/719,438, Mar. 2010.

*Primary Examiner* — Vijay Shankar
(74) *Attorney, Agent, or Firm* — Greenblum & Bernstein, P.L.C.

(57) ABSTRACT

An electronic device is described. The device includes a substrate for a luminescence panel that includes data lines and pixels in which a luminescence element can be formed. Each pixel includes a driving transistor that converts a signal voltage from a data line into a signal current, and a first switch between the data line and the gate of the driving transistor. The device includes a first circuit to flow a test current from the data line through the driving transistor, a second circuit to generate a voltage on the data line corresponding to a gate voltage on the driving transistor generated by the test current, and a voltage detector to detect the voltage in the data line.

11 Claims, 18 Drawing Sheets

U.S. PATENT DOCUMENTS

2011/0141095 A1 6/2011 Matsui et al.

FOREIGN PATENT DOCUMENTS

| | | |
|---|---|---|
| JP | 2004-004673 | 1/2004 |
| JP | 2004-4675 | 1/2004 |
| JP | 2005-265937 | 9/2005 |
| JP | 2006-018167 | 1/2006 |
| JP | 2006-139079 | 6/2006 |
| JP | 2007-47721 | 2/2007 |
| JP | 2007-206139 | 8/2007 |
| JP | 2007-322133 | 12/2007 |
| JP | 2007-536585 | 12/2007 |
| JP | 2008-102404 | 5/2008 |
| JP | 2008-139861 | 6/2008 |
| JP | 2008-224863 | 9/2008 |
| JP | 2008-224864 | 9/2008 |
| WO | 2005/109389 | 11/2005 |
| WO | 2007/037269 | 4/2007 |

* cited by examiner

DISPLAY DEVICE, ELECTRONIC DEVICE, AND DRIVING METHOD

CROSS-REFERENCE RELATED APPLICATIONS

The present application is a division of U.S. application Ser. No. 12/823,234, filed Jun. 25, 2010, which is a Continuation of Application of PCT/JP2008/004022, filed Dec. 26, 2008, the disclosures of which are incorporated herein by reference in their entireties.

The disclosure of Japanese Patent Application No. 2008-000779 filed on Jan. 7, 2008, including the specification, drawings and claims, is incorporated herein by reference in its entirety.

BACKGROUND OF THE INVENTION

1. Field of the Invention

The present invention relates to display devices, electronic devices, and driving methods thereof, and particularly to a display device using especially current-driven luminescence elements, an electronic device, and driving methods thereof.

2. Description of the Related Art

Image display devices (organic EL displays) using organic light emitting diodes (OLEDS) are known as image display devices using current-driven luminescence elements. The organic EL displays have advantages such as viewing angle properties and low power consumption, and thus have attracted attention as next-generation flat panel display (FPD) candidates.

In a usual organic EL display, organic EL elements serving as pixels are arranged in a matrix. An organic EL display is called a passive-matrix organic EL display, in which organic EL elements are provided at intersections of row electrodes (scanning lines) and column electrodes (data lines) and voltages corresponding to data signals are applied to between selected row electrodes and the column electrodes to drive the organic EL elements.

On the other hand, an organic EL display is called an active-matrix organic EL display, in which thin-film transistors (TFTs) are provided at intersections of scanning lines and data lines, connected to gates of driving transistors, and turned on through selected scanning lines, and then data signals are inputted to the driving transistors via signal lines.

Unlike the passive-matrix organic EL display in which organic EL elements connected to each of the row electrodes (scanning lines) produce luminescence only in a period during which each row electrode is being selected, a decrease in luminance of a display is not caused even when a duty ratio increases, because the active-matrix organic EL display allows the organic EL elements to produce luminescence until next scanning (selection). Thus, the active-matrix organic EL display can be driven at a low voltage, thereby achieving less power consumption. However, the active-matrix organic EL display has a disadvantage that, even when the same data signals are provided, each of pixels has different luminance of organic EL element due to characteristic variation of a driving transistor or an organic EL element, and luminance unevenness occurs.

For a conventional organic EL display, for instance, a compensation using complex pixel circuits, a feedback compensation using representative pixels, and a feedback compensation using a sum of currents flowing in all pixels are representative as a compensation method for luminance unevenness caused by characteristic variation or deterioration of a driving transistor or an organic EL element (hereinafter, collectively referred to as uneven characteristic).

However, the complex pixel circuits reduce yield. In addition, the feedback using the representative pixels and the feedback using the sum of currents flowing in all the pixels do not make it possible to compensate the uneven characteristic for each pixel.

For the above reasons, methods for use in simple pixel circuits which detect an uneven characteristic for each pixel have been proposed.

For example, in a substrate for luminescence panel, a test method thereof, and a luminescence panel disclosed in Patent Reference 1 (Japanese Unexamined Patent Application Publication No. 2006-139079), a voltage driving pixel circuit including two conventional transistors is connected to a transistor as a diode, a current flowing into a test line connected to the transistor connected as the diode is measured in a substrate for luminescence panel before EL formation, with the transistor being regarded as an EL element, a relationship between a data voltage and a current flowing into a driving transistor is detected, and pixel test and pixel characteristic extraction are performed. Furthermore, the transistor connected as the diode makes it possible to prevent a current from flowing as a reverse bias, using the test line, after the EL formation, and thus a normal voltage writing operation can be performed. Moreover, a characteristic detected for each pixel can be used for correction control of an applied voltage to a data line at the time of using an organic EL luminescence panel.

SUMMARY OF THE INVENTION

However, a driving current flowing into a pixel is very minute, and it is difficult to accurately measure the minute current. In addition, a change in characteristic caused by initial characteristic variation or deterioration occurs not only in a transistor but also in an organic EL element, and thus luminance unevenness of each pixel cannot be compensated with a method which does not detect an organic EL characteristic.

Further, the conventional methods do not include accurately compensating temporal change of the characteristics of the driving transistor and the organic EL element in an operation after the luminescence panel is formed. Generally, a driving transistor has initial characteristic variation when the driving transistor is made of low-temperature polysilicon, but a subsequent characteristic of the driving transistor is stable. On the other hand, when the driving transistor is made of amorphous silicon favorable to an increase in luminescence panel area, temporal change of a characteristic parameter is great. Moreover, generally, a life property of an organic EL element also depends on an integrated time period of a driving current. Thus, it is important to accurately compensate the change of the characteristic parameter of each of the driving transistor and the organic EL element which is caused by the temporal change.

As stated above, the conventional techniques have a problem that the accuracy of detecting a characteristic is bad because current measurement is used when the characteristic of the transistor is detected, and another problem that the panel after the formation of organic EL element does not include a detecting unit which detects the characteristic of the organic EL element.

In view of the above problems, the first objective of the present invention is to provide a display device, an electronic device, and driving methods thereof which make it possible to accurately detect respective characteristics of a transistor and an organic EL element of each of pixels through voltage measurement, even though pixel circuits are simple. The second objective of the present invention is to provide the display device, the electronic device, and the driving methods thereof which make it possible to correct luminance unevenness caused by the uneven characteristic of the driving transistor or the organic EL element, using the detection result.

In order to achieve the above objectives, a display device according to an aspect of the present invention is a display device including an active-matrix luminescence panel including pixel units and data lines for determining luminescence of the pixel units, wherein each of the pixel units includes: a first transistor which converts a signal voltage supplied from one of the data lines into a signal current; a first switching element which is provided between the one of the data lines and a gate of the first transistor and switches between conduction and non-conduction between the one of the data lines and the gate of the first transistor; and a luminescence element which produces luminescence according to the signal current flowing from a first terminal of the first transistor to one of an anode and a cathode of the luminescence element, the first terminal being one of a source and a drain of the first transistor, and the display device includes: a first circuit path forming unit which forms a first circuit path so that a first test current provided from the one of the data lines is passed between the source and the drain of the first transistor and a second test current provided from the one of the data lines is passed to the luminescence element; a second circuit path forming unit which forms a second circuit path so that a voltage and an other voltage of the one of the anode and the cathode of the luminescence element are generated in the one of the data lines, the voltage corresponding to a gate voltage of the first transistor being generated by the first test current, and the other voltage being generated by the second test current; and a voltage detection unit which detects the voltage and the other voltage in the one of the data lines via the second circuit path.

With this, it is possible to independently obtain characteristic information about variation of the first transistor which is a driving transistor. Moreover, in comparison to a conventional measuring method of detecting a minute current by providing a voltage, highly accurate measurement is achieved, because a test current flows into the driving transistor and a voltage of a data line at the time of the flow of the test current is measured. Further, luminance unevenness caused by an uneven characteristic of the driving transistor can be reduced by using the obtained characteristic information to correct the data voltage during normal operation.

Moreover, it is possible to independently obtain characteristic information about variation of the first transistor which is a driving transistor and an luminescence element. Furthermore, in the case where both of the organic EL element and the driving transistor undergo time degradation, detection of the characteristics of the both makes it possible to control a data voltage for achieving desired luminescence intensity more appropriately. Thus, it is possible to reduce the luminance unevenness caused by uneven characteristics of the driving transistor and the luminescence element by using a highly accurate correction data voltage, which cannot be derived from only the detection of the characteristic of the driving transistor, in correcting the data voltage during normal operation.

Moreover, the display device may be a display device including scanning lines each of which transmits a control signal; and first control lines, wherein the first transistor is a driving transistor which has a second terminal connected to a first power source and provides, from the first terminal, a current corresponding to a potential difference between the gate and the source of the first transistor, the second terminal being the other of the source and the drain of the first transistor, the luminescence element has the other of the anode and the cathode connected to a second power source, the first switching element is a first switching transistor which has a gate connected to one of the scanning lines, one of a source and a drain connected to the one of the data lines, and the other of the source and the drain connected to, the gate of the first transistor, the first circuit path forming unit includes a test current generation circuit which supplies the first test current and the second test current to the one of the data lines, and a single second switching transistor which has a gate connected to one of the first control lines, one of a source and a drain connected to the one of the data lines, and the other of the source and the drain connected to a connection point between the first terminal and the other of the anode and the cathode of the luminescence element, and the second circuit path former includes the first switch and the second switch.

With this, a simple circuit configuration including only two switching transistors makes it possible to pass the test current from the data line to the driving transistor and detect the gate voltage of the driving transistor in the data line.

Furthermore, the first circuit path forming unit may include the test current generation circuit which supplies the first test current and the second test current to the one of the data lines, and the test current generation circuit may pass the first test current to the first transistor, with a bias voltage value of the first power source and a bias voltage value of the second power source changing synchronously, when the first switching transistor and the second switching transistor are in on-state.

With this, it is possible to control a path of the test current flowing into the driving transistor, because a forward-bias or a reverse-bias voltage is arbitrarily applied to the driving transistor.

In addition, a simple circuit configuration including only two switching transistors makes it possible to pass the test current from the data line to the driving transistor or the luminescence element, and detect the gate voltage of the driving transistor or the voltage of the luminescence element in the data line.

Moreover, the test current generation circuit may pass the second test current to the luminescence element, with a bias voltage value of the first power source and a bias voltage value of the second power source changing synchronously, when the second switching transistor is in on-state.

With this, it is possible to control a path of the test current flowing into the driving transistor and the luminescence element, because a forward-bias or a reverse-bias voltage is arbitrarily applied to the driving transistor and the luminescence element.

Furthermore, each of the pixel units may further include a third switch which is provided between the other of the source and the drain of the driving transistor and the first power source, and which switchedly supplies the second test current.

Alternatively, each of the pixel units may further include a third switch which is provided between the one of the source and the drain of the driving transistor and a connection point between the other of the source and the drain of the second switch and the one of the anode and the cathode of the luminescence element, and which switchedly supplies the second test current.

Further, each of the pixel units may further include a third switch which is provided between the other of the source and the drain of the second switch and the one of the anode and the cathode of the luminescence element, and which switchedly supplies the first test current.

With the above, when the inserted switching element is turned on or off, it is possible to control the path of the test current of the driving transistor and the luminescence element.

Moreover, it is preferable that the test current generation circuit includes: one or more current generators which generate the first test current and the second test current; and a multiplexer which is provided between the one or more current generators and the data lines and causes at least selected one of the data lines and one of the one or more current generators to be conductive, and the number of the one or more current generators is fewer than the number of the data lines.

This reduces the number of the current generators required at the time of measuring the characteristic of the driving transistor or the luminescence element, which thus leads to area reduction of the display device and reduction in the number of components.

Furthermore, the display device may further include: scanning lines each of which transmits a control signal; and first control lines, wherein the first transistor is a driving transistor which has a second terminal connected to a first power source and provides, from the first terminal, a current corresponding to a difference in potential between the gate and the source of the first transistor, the second terminal being the other of the source and the drain of the first transistor, the luminescence element has the other of the anode and the cathode connected to a second power source, the first switching element is a first switching transistor which has a gate connected to one of the scanning lines, one of a source and a drain connected to the one of the data lines, and the other of the source and the drain connected to the gate of the first transistor, the first circuit path forming unit includes a test current generation circuit which supplies the first test current and the second test current to the one of the data lines, and a second switching transistor which has a gate connected to one of the first control lines, one of a source and a drain connected to the other of the source and the drain of the first switching transistor, and the other of the source and the drain connected to a connection point between the first terminal and the one of the anode and the cathode of the luminescence element, and the second circuit path former includes the first switch and the second switch.

With this, a simple circuit configuration including only two switching transistors makes it possible to pass the test current from the data line to the driving transistor and detect the gate voltage of the driving transistor in the data line.

Moreover, the display device may further include scanning lines each of which transmits a control signal, wherein the first transistor is a driving transistor which has a second terminal connected to a first power source and provides, from the first terminal, a current corresponding to a difference in potential between the gate and the source of the first transistor, the second terminal being the other of the source and the drain of the first transistor, the luminescence element has the other of the anode and the cathode connected to a second power source, the first switching element is a first switching transistor which has a gate connected to one of the scanning lines, one of a source and a drain connected to the one of the data lines, and the other of the source and the drain connected to the gate of the first transistor, the first circuit path forming unit includes a test current generation circuit which supplies the first test current and the second test current to the one of the data lines, and each of the pixel units is further provided between the gate of the first transistor and the other of the source and the drain of the first switching transistor, and includes a voltage conversion unit which provides, to the gate of the first transistor, a voltage corresponding to the signal voltage.

With this, in addition to a basic circuit configuration during normal operation of the display device, a circuit in which the voltage converting unit is inserted between the gate of the driving transistor and the first switching transistor also makes it possible to pass the test current from the data line to the driving transistor, using the first circuit path forming unit, the second circuit path forming unit, and the voltage detection unit, and detect the gate voltage of the driving transistor in the data line.

Furthermore, the display device may further include second control lines each of which transmits a control signal, wherein each of the pixel units includes a transistor which has a gate connected to one of the second control lines, one of a source and a drain connected to the gate of the first transistor, and the other of the source and the drain connected to the first terminal.

With this, even a circuit for which a threshold voltage of the driving transistor is compensated makes it possible to pass the test current from the data line to the driving transistor, suing the first circuit path forming unit, the second circuit path forming unit, and the voltage detection unit, and detect the gate voltage of the driving transistor in the data line.

Moreover, it is preferable that the voltage detection unit includes: one or more voltage detectors which measure, in the one of the data lines, the voltage or the other voltage; and a multiplexer which is provided between the one or more voltage detectors and the data lines and causes at least selected one of the data lines and one of the one or more voltage detectors to be conductive, and the number of the one or more voltage detectors is fewer than the number of the data lines.

This reduces the number of the voltage detectors required at the time of measuring the characteristic of the driving transistor, which thus leads to area reduction of the display device and reduction in the number of components.

In addition, the number of the voltage detectors required at the time of measuring the characteristic of the driving transistor or the luminescence element is reduced, which thus leads to the area reduction of the display device and the reduction in the number of components.

Moreover, it is preferable that the multiplexer is formed above the luminescence panel.

With this, regions other than a luminescence panel are reduced, and thus a display device having a high ratio of luminescent display region is realized.

Furthermore, a display device according to an aspect of the present invention is a display device including an active-matrix luminescence panel including pixel units and data lines for determining luminescence of the pixel units, wherein each of the pixel units includes: a first transistor which converts a signal voltage supplied from one of the data lines into a signal current; a first switching element which is provided between the one of the data lines and a gate of the first transistor and switches between conduction and non-conduction between the one of the data lines and the gate of the first transistor; and a luminescence element which produces luminescence according to the signal current flowing from a first terminal of the first transistor to one of an anode and a cathode of the luminescence element, the first terminal being one of a source and a drain of the first transistor, and the display device includes: a first circuit path forming unit which forms a first circuit path so that a second test current provided from the one of the data lines is passed to the luminescence element; a second circuit path forming unit which forms a second circuit path so that a voltage of the one of the anode and the cathode of the luminescence element is generated in the one of the data lines, the voltage being generated by the second test current; and a voltage detection unit which detects the voltage in the one of the data lines via the second circuit path.

With this, it is possible to independently obtain characteristic information about variation of the luminescence element. Moreover, in comparison to a conventional measuring method of detecting a minute current by providing a voltage, highly accurate measurement is achieved, because a test current flows to the driving transistor and a voltage of a data line at the time of the flow of the test current is measured. Further, luminance unevenness caused by an uneven characteristic of the luminescence element can be reduced by using the obtained characteristic information to correct the data voltage during normal operation.

Furthermore, an electronic device according to an aspect of the present invention is an electronic device including a substrate for luminescence panel which includes data lines and pixels units in which a luminescence element can be formed, wherein each of the pixel units includes: a first transistor which converts a signal voltage supplied from one of the data lines into a signal current; and a first switching element which is provided between the one of the data lines and a gate of the first transistor and switches between conduction and non-conduction between the one of the data lines and the gate of the first transistor, and the electronic device includes: a first circuit path forming unit which forms a first circuit path so that a test current provided from the one of the data lines is passed between a source and a drain of the first transistor; a second circuit path forming unit which forms a second circuit path so that a voltage is generated in the one of the data lines, the voltage corresponding to a gate voltage of the first transistor being generated by the test current; and a voltage detection unit which detects, in the one of the data lines, the voltage corresponding to a gate voltage of the first transistor being generated by the test current.

With this, before the luminescence element is formed, it is possible to obtain characteristic information about variation of the first transistor which is a driving transistor. Moreover, in comparison to a conventional measuring method of detecting a minute current by providing a voltage, highly accurate measurement is achieved, because a test current flows into the driving transistor and a voltage of a data line at the time of the flow of the test current is measured. Further, luminance unevenness caused by an uneven characteristic of the driving transistor can be reduced by using the obtained characteristic information to correct the data voltage during normal operation.

The present invention is realized not only as the display device or the electronic device including the above characteristic units but also as a driving method which is performed by the display device or the driving method and includes, as steps, the characteristic units of the display device or the electronic device.

The display device, the electronic device, and the driving methods thereof make it possible to highly accurately measure respective characteristics of a driving transistor and an organic EL element of each of pixels, using a simple pixel circuit configuration and in addition through voltage measurement having a high degree of accuracy, and thus produce an advantageous effect of correcting luminance unevenness caused by an uneven characteristic of the driving element or the luminescence element.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DESCRIPTION OF THE PREFERRED EMBODIMENT(S)

(Embodiment 1)

A display device according to Embodiment 1 includes an active-matrix luminescence panel including pixel units, wherein each of the pixel units includes a first transistor which provides a signal current corresponding to a signal voltage provided from a selected data line; a first switching element which switches between supply and non-supply of the signal voltage to the first transistor; a luminescence element which outputs an optical signal in response to the provision of the signal current; and a second switching element which is connected so that the selected data line and a second terminal of the first transistor can be in short circuit condition. In addition, the display device includes: a test current generation circuit which passes a test current to the first transistor or the luminescence element; and a voltage detection circuit which measures a voltage generated by the test current in the selected data line. Accordingly, characteristics of the driving transistor and the luminescence element provided to each pixel can be independently measured with a high degree of accuracy, and thus it is possible to correct luminance unevenness caused by an uneven characteristic of the driving transistor or the luminescence element.

Figure 1:
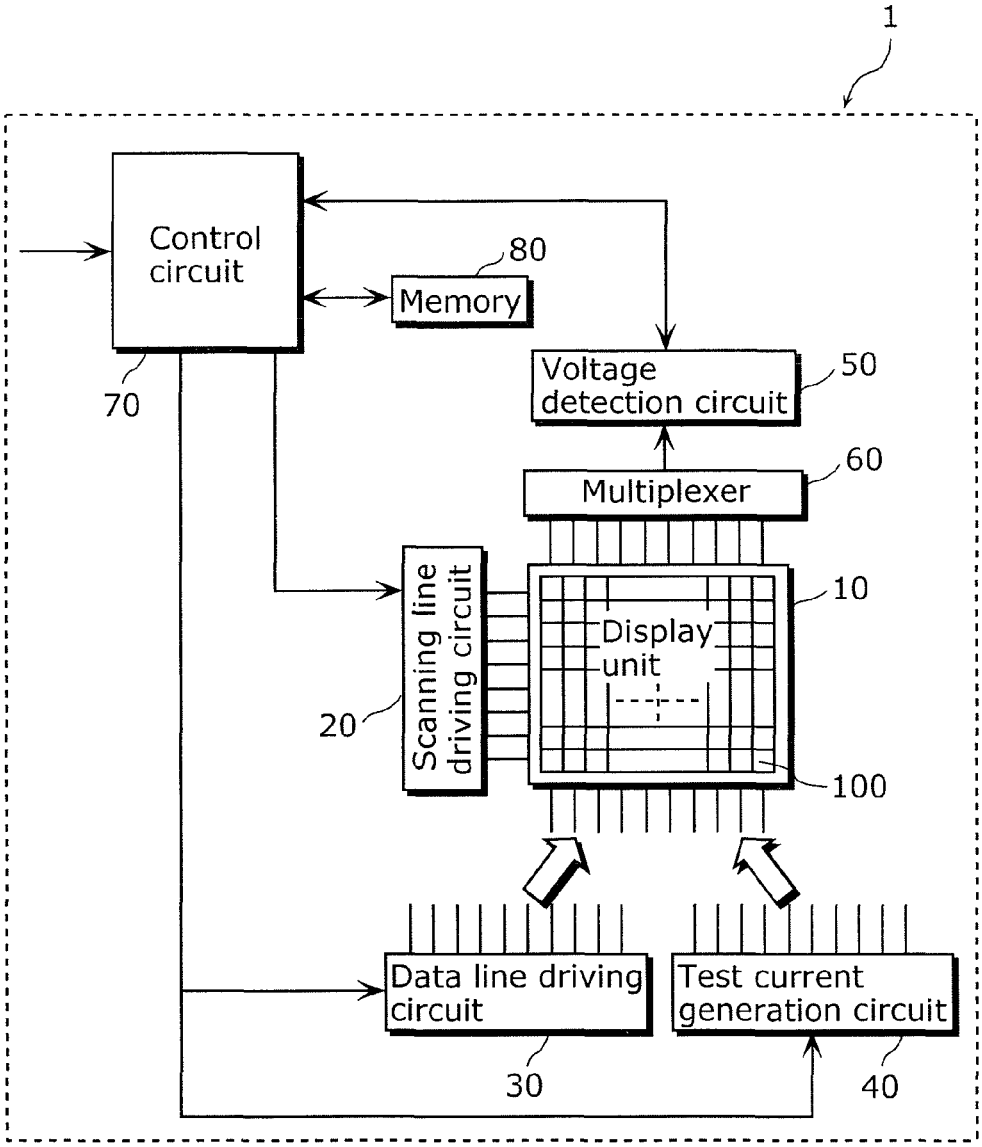
FIG. 1 is a block diagram showing an electrical configuration of a display device according to Embodiment 1 of the present invention.

FIG. 1 is a block diagram showing an electrical configuration of a display device according to Embodiment 1 of the present invention. A display device 1 in the figure includes a display unit 10, a scanning line driving circuit 20, a data line driving circuit 30, a test current generation circuit 40, a voltage detection circuit 50, a multiplexer 60, a control circuit 70, and a memory 80.

The display unit 10 includes pixel units 100.

Figure 2:
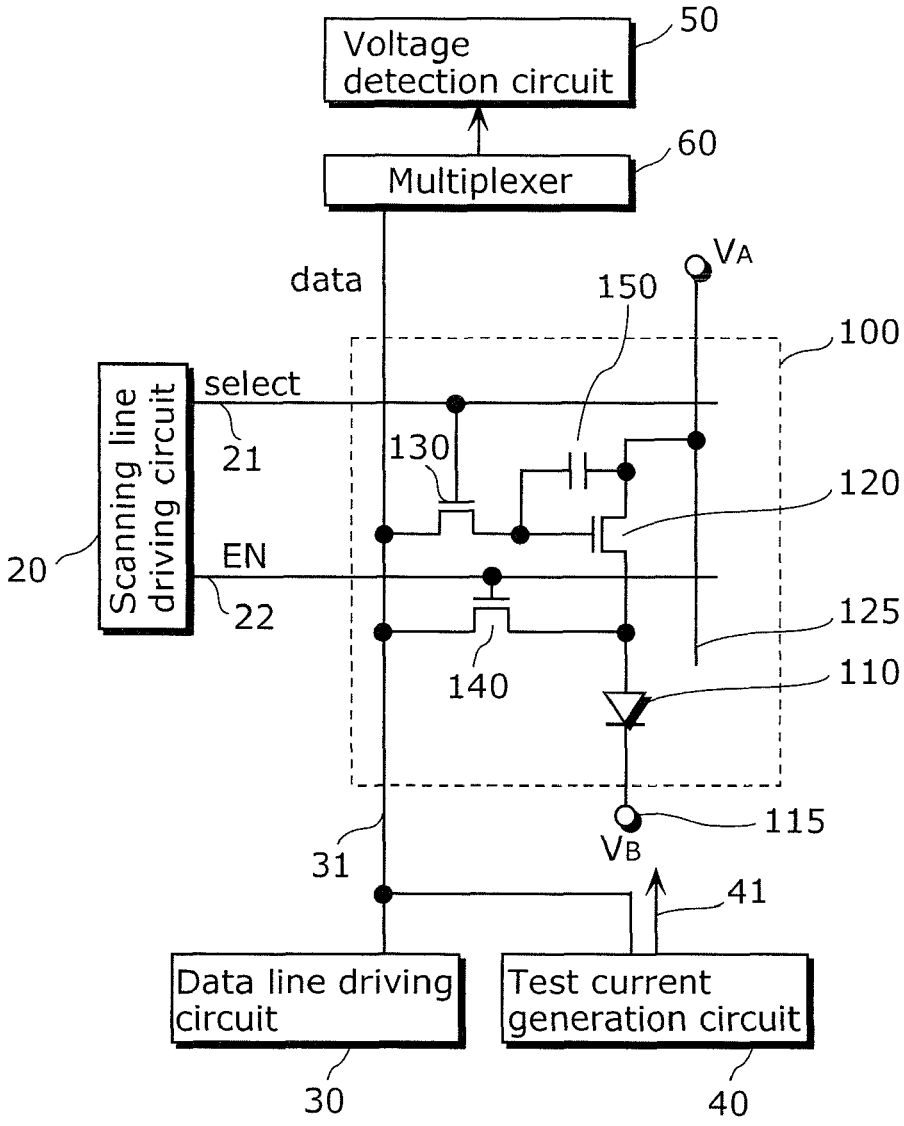
FIG. 2 is a diagram showing a circuit configuration of one of pixel units included in a display unit and a connection between the pixel unit and peripheral circuitry thereof.

FIG. 2 is a diagram showing a circuit configuration of one of pixel units included in a display unit and a connection between the pixel unit and peripheral circuitry thereof. A pixel unit 100 in the figure includes an organic EL element 110, a driving transistor 120, a switching transistor 130, a test transistor 140, a capacitor element 150, a common electrode 115, a power line 125, a scanning line 21, a control line 22, and a data line 31. In addition, the peripheral circuitry includes the scanning line driving circuit 20, the data line driving circuit 30, the test current generation circuit 40, the voltage detection circuit 50, and the multiplexer 60.

First, the following describes the functions of the components shown in FIG. 1.

The scanning line driving circuit 20 is connected to the scanning line 21 and the control line 22 that is a first control line, and controls conduction and non-conduction of the switching transistor 130 and the test transistor 140 that are included in the pixel unit 100.

The data line driving circuit 30 is connected to the data line 31, and outputs a signal voltage to determine a signal current to be passed into the driving transistor 120. In addition, the data line driving circuit 30 includes a switch which allows opening and short-circuiting of the connection to the data line 31.

The test current generation circuit 40 is connected to the data line 31, and provides a test current so as to detect a characteristic of the driving transistor 120 or the organic EL element 110. The test current generation circuit 40 is a component of a first circuit path forming unit.

The voltage detection circuit 50 is connected via the multiplexer 60 to the data line 31, and detects a voltage of the data line 31 while the test current generation circuit 40 is providing the test current. The voltage detection circuit 50 is a component of a second circuit path forming unit.

The multiplexer 60 switches the data line 31 connected to the voltage detection circuit 50.

The control circuit 70 controls the scanning line driving circuit 20, the data line driving circuit 30, the test current generation circuit 40, the multiplexer 60, the voltage detection circuit 50, and the memory 80. The voltage value detected by the voltage detection circuit 50 is converted into a digital value, and the digital value is turned into a characteristic parameter through a calculation. Then, the control circuit 70 writes the characteristic parameter into the memory 80. In addition, the control circuit 70 reads out the characteristic parameter written in the memory 80, corrects video signal data inputted externally based on the characteristic parameter, and outputs the corrected data to the data line driving circuit 30.

The following describes the internal circuit configuration of the pixel unit 100 with reference to FIG. 2.

The transistor 120 functions as a first transistor, and has a gate connected via the switching transistor 130 to the data line 31, one of a source and a drain, which is a first terminal, connected to an anode that is one of terminals of the organic EL element 110, and the other of the source and the drain, which is a second terminal, connected to the power line 125.

The switching transistor 130 functions as a first switching transistor, and has a gate connected to the scanning line 21.

The test transistor 140 functions as a second transistor, and is a component of the first circuit path forming unit which forms a test current path. In addition, the test transistor 140 also serves as a component of a second circuit path forming unit which forms a voltage path for measuring an anode voltage of the organic EL element 110. The test transistor 140 has a gate connected to the control line 22, a source connected to an anode that is one of terminals of the organic EL element 110, and a drain connected to the data line 31.

The capacitor element 150 is connected between the power line 125 and the gate terminal of the driving transistor 120.

The organic EL element 110 functions as a luminescence element, and has a cathode that is the other of the terminals, connected to the common electrode 115.

It is to be noted that the power line 125 is connected to the same power source, though not shown in FIGS. 1 and 2. In addition, the common electrode 115 is connected to the power source.

The following describes a driving method of the display device according to Embodiment 1 of the present invention. The driving method makes it possible to detect the characteristic of the driving transistor 120 and the characteristic of the organic EL element 110.

Figure 3:
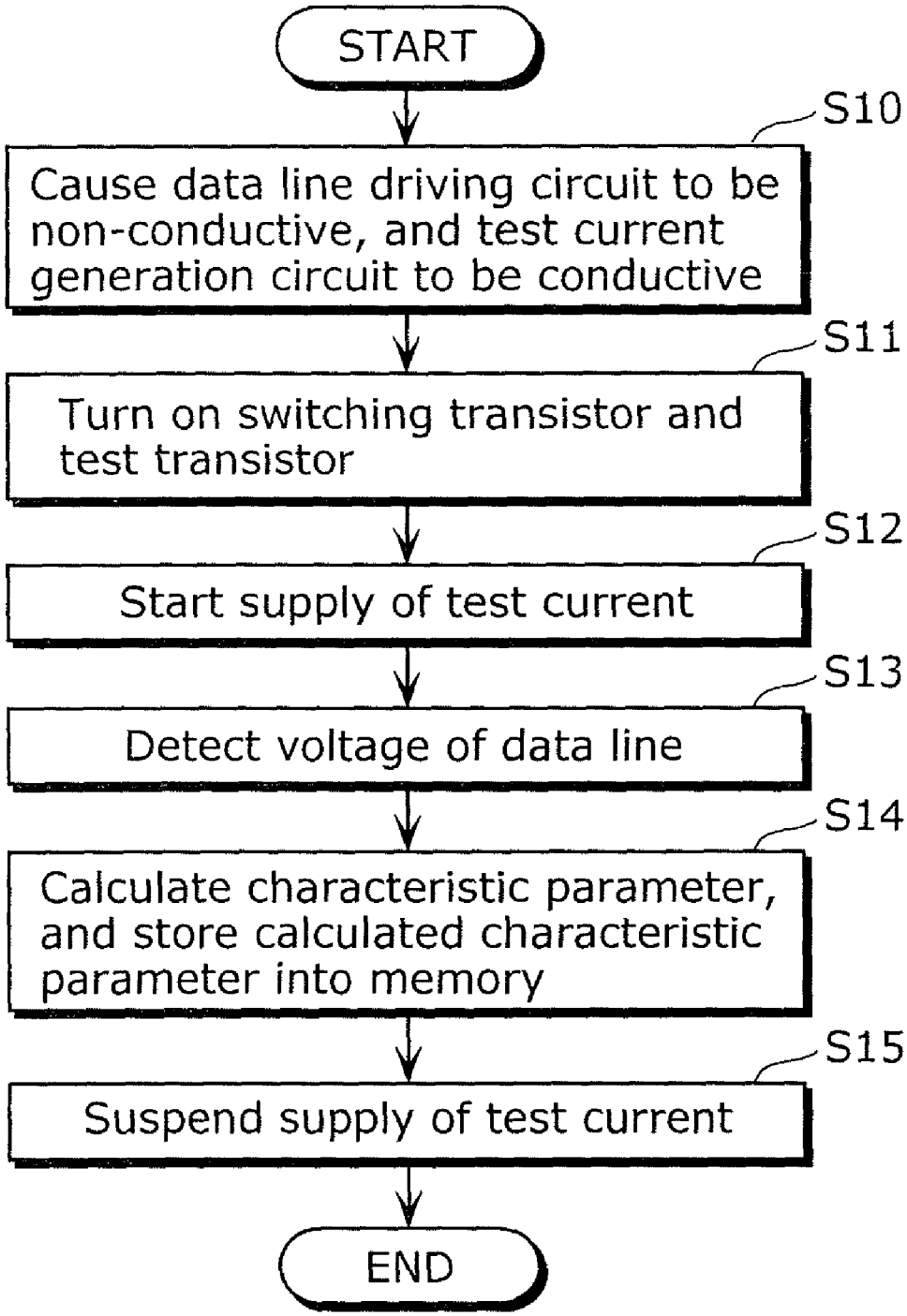
FIG. 3 is an operation flowchart of a control circuit included in the display device according to Embodiment 1 of the present invention in the case where a characteristic of a driving transistor or an organic EL element is detected.

FIG. 3 is an operation flowchart of a control circuit included in the display device according to Embodiment 1 of the present invention in the case where a characteristic of a driving transistor or an organic EL element is detected.

Initially, the connection between the data line driving circuit 30 and the data line 31 is in a non-conduction state, and the connection between the test current generation circuit 40 and the data line 31 is set to a conduction state (S10). The connection is realized by, for instance, turning off a switch between the data line driving circuit 30 and the data line 31 or turning on a switch between the test current generation circuit 40 and the data line 31.

Figure 4:
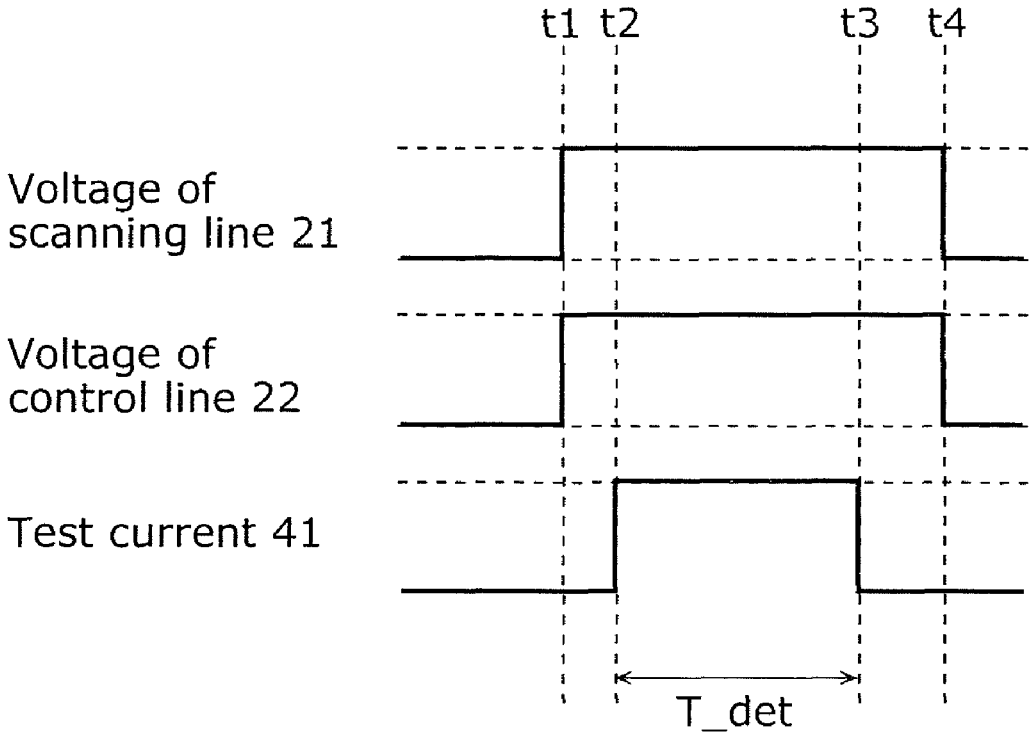
FIG. 4 is a timing diagram showing a test current supply timing in the case where the characteristic of the driving transistor or the organic EL element is detected.

FIG. 4 is a timing diagram showing a test current supply timing in the case where the characteristic of the driving transistor or the organic EL element is detected. In the figure, the horizontal axis indicates a time. Moreover, in the vertical direction, wave form charts of a voltage generated in the scanning line, a voltage generated in the control line 22, and a test current 41 are shown in this order.

Next, at t1 in FIG. 4, voltage levels of the scanning line 21 and the control line 22 are set to high to turn on the switching transistor 130 and the test transistor 140, respectively (S11). It is to be noted that when the characteristic of the organic EL element is detected, the switching transistor 130 may be in off-state.

Next, at t2 in FIG. 4, the test current generation circuit 40 supplies the test current 41 in a direction shown in FIG. 2 (S12).

In step S12, when the characteristic of the driving transistor 120 is detected, a variable voltage $V_B$ is applied to the common electrode 115 such that a second power source connected to the common electrode 115 applies a reverse bias to the organic EL element 110, and thus the test current 41 does not flow into the organic EL element 110. Accordingly, the test current 41 flows, as a first test current, via the data line 31, the test transistor 140, and the driving transistor 120 into the power line 125. At that time, the gate terminal of the driving transistor 120 is connected to the data line 31, because the switching transistor 130 is in on-state. Therefore, the voltage of the data line 31 becomes almost equal to the gate voltage of the driving transistor 120 when the test current 41 flows into the driving transistor 120.

On the other hand, in step S12, when the characteristic of the organic EL element 110 is detected, a variable voltage $V_A$ that is almost equal to or higher than the gate voltage of the driving transistor 120 is applied to the power line 125 such that a first power source connected to the power line 125 does not supply a current to the driving transistor 120, and thus the test current 41 flows, as a second test current, via the data line 31, the test transistor 140, and the organic EL element 110 into the common electrode 115. At that time, the anode terminal of the organic EL element 110 is connected to the data line 31, because the test transistor 140 is in on-state. Therefore, the voltage of the data line 31 becomes almost equal to the anode voltage of the organic EL element 110 when the test current 41 flows into the organic EL element 110.

Next, between t2 and t3 in FIG. 4, the test current 41 is supplied, and the voltage detection circuit 50 detects a voltage appearing on the data line 31 (S13). This makes it possible to obtain the gate voltage of the driving transistor 120 or the anode voltage of the organic EL element 110 with respect to magnitude of the test current 41.

Here, when the characteristic of the driving transistor 102 is detected, the driving transistor 120 operates in a saturation region, because the gate terminal and the drain terminal of the driving transistor 120 are connected with each other via the switching transistor 130 and the test transistor 140. Furthermore, the source voltage of the driving transistor 120 is a voltage applied to the power line 125. Here, where the detected voltage is $V_{det}$, the power supply voltage applied to the source terminal of the driving transistor 120 is $V_{dd}$, and the test current is $I_{test}$, the following Equation 1 holds.

[Math. 1]

$$I_{test}=(\beta/2)(V_{det}-V_{dd}-Vth)^2 \quad \text{(Equation 1)}$$

Here, β is a characteristic parameter for a channel region, an oxide file capacity, and a mobility of the driving transistor 120, and $V_{th}$ is a threshold voltage of the driving transistor 120 and relates to the mobility.

From Equation 1, where voltages detected by passing two types of test currents $I_1$ and $I_2$ each having different magnitude are $V_{det1}$ and $V_{det2}$, respectively, the following simultaneous equation can be written.

[Math. 2]

$$I_1=(\beta/2)(V_{det1}-V_{dd}-Vth)^2 \quad \text{(Equation 2)}$$

[Math. 3]

$$I_2=(\beta/2)(V_{det2}-V_{dd}-Vth)^2 \quad \text{(Equation 3)}$$

When equations are $V_{gs1}=V_{det1}-V_{dd}$ and $V_{gs2}=V_{det2}-V_{dd}$ and the simultaneous equation is solved, β and $V_{th}$ are respectively expressed as follows.

[Math. 4]

$$\beta=\left(\frac{\sqrt{2I_1}-\sqrt{2I_2}}{V_{gs1}-V_{gs2}}\right)^2 \quad \text{(Equation 4)}$$

$$Vth=\frac{V_{gs2}\times\sqrt{2I_1}-V_{gs1}\times\sqrt{2I_2}}{\sqrt{2I_1}-\sqrt{2I_2}}$$

In this manner, the characteristic parameter such as the mobility of the driving transistor 120 and a threshold value can be calculated by passing the test current 41 and measuring the voltage of the data line 31 at the time of the passing.

On the other hand, when the characteristic of the organic EL element 110 is detected, an initial current-voltage characteristic of the organic EL element 110 which has been obtained and a deviation from ($I_{EL}$, $V_{EL}$) which is obtained now are calculated. Here, $I_{EL}$ indicates the test current 41, and $V_{EL}$ indicates the generated anode voltage of the organic EL element 110.

Next, the control circuit 70 converts the voltage values $V_{det1}$ and $V_{det2}$ detected by the voltage detection circuit 50, or $V_{EL}$, into a digital value, and stores, into the memory 80, the characteristic parameter calculated using the digital value and Equation 2 or 4 or the initial characteristic parameter (S14).

Next, at t3 in FIG. 4, the supply of the test current is suspended (S15).

It is to be noted that step S15 does not necessarily follow step S14, and may be performed in parallel with step S14 or after step S13 and before step S14.

With the above series of the operation steps, the voltage of the data line is measured and the detection result is evaluated, and thus not only is a pixel defect in the pixel unit discovered, but also information about the characteristic variation of the driving transistor or the organic EL element and the time variation is independently obtained. The obtained characteristic parameter is stored into the memory and the characteristic parameter is used in correcting the data voltage at the time of normal operation (to be described later), and thus the luminance unevenness caused by the characteristic variation of the driving transistor or the organic EL element and the time variation is suppressed.

The following describes a driving method of the display device during normal operation according to Embodiment 1 of the present invention.

Figure 5:
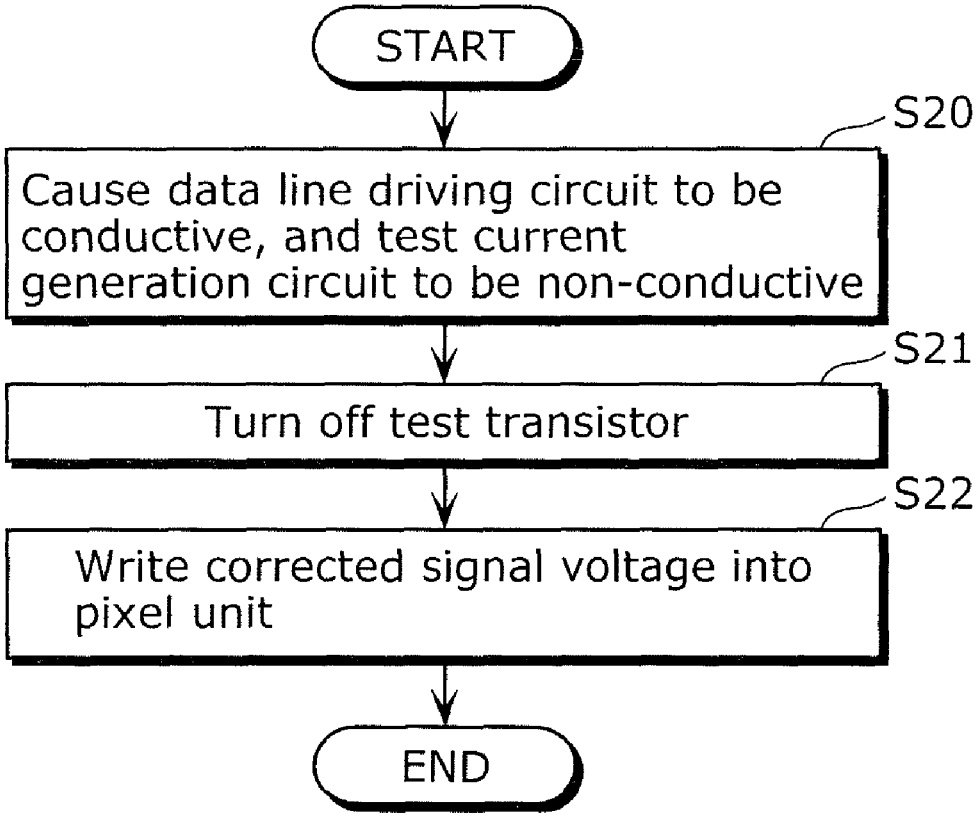
FIG. 5 is an operation flowchart of the control circuit during normal operation.

FIG. 5 is an operation flowchart of the control circuit during normal operation.

Initially, the connection between the data line driving circuit 30 and the data line 31 is in a conduction state, and the connection between the test current generation circuit 40 and the data line 31 is set to a non-conduction state (S20). The connection is realized by, for example, setting the output current of the test current generation circuit 40 to zero. In addition, the connection may be opened by taming of a switch provided between the test current generation circuit 40 and the data line 31.

Next, the test transistor 140 is turned off (S21). It is to be noted that step S21 may be performed before step S20. In addition, although the test transistor 140 is always in off-state during normal operation, step S21 may be used for black insertion at the time of driving, because the output voltage of the data line driving circuit 30 can be directly applied to the organic EL element 110 by turning on the test transistor 140.

Lastly, a signal voltage corrected using the characteristic parameter read out from the memory 80 is provided from the data line driving circuit 30 and is written into the pixel unit 100, and thus image display is performed (S22).

As stated above, with the operations of detecting the characteristic of the driving transistor or the organic EL element and the normal operation, the signal voltage is corrected based on the characteristic parameter obtained at the time of detecting the characteristic, and thus the luminance unevenness caused by the characteristic variation of the driving transistor or the organic EL element and the time variation is suppressed.

It is to be noted that although the voltage detection circuit 50 and the test current generation circuit 40 each are connected on a corresponding one of the ends of the data line 31 with the pixel unit being sandwiched therebetween, the voltage detection circuit 50 and the test current generation circuit 40 may be connected on the same end of the data line 31 with respect to the pixel unit. In the case where a large test current is passed into the data line 31 and the voltage of the data line 31 is measured, there is a possibility that detection accuracy is decreased by voltage drop caused by the wiring resistance of the data line 31 when the voltage detection circuit 50 is provided on the same side as the test current generation circuit 40. In this case, it is preferable that the voltage detection circuit 50 and the test current generation circuit 40 each are connected on the corresponding one of the ends of the data line 31 with the pixel unit being sandwiched therebetween. In the case where it is desired that a detection time period is shortened by increasing the test current, a configuration in which each of connections is made on a corresponding one of the ends of the data line 31 is very effective.

Furthermore, together with the data line driving circuit 30, the test current generation circuit 40 may be included in a data driver IC or may be provided independent of the data driver IC.

Figure 6:
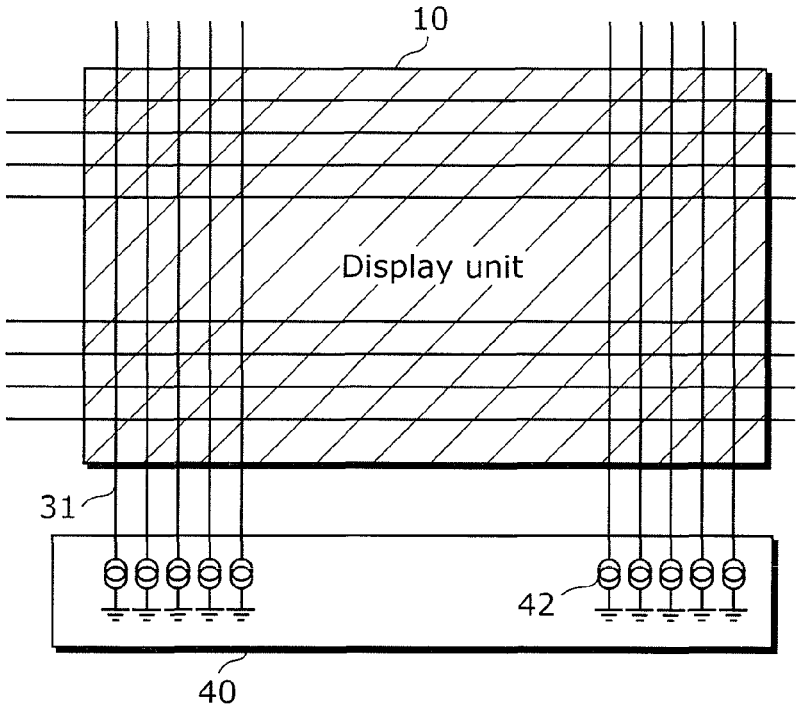
FIG. 6 is a diagram showing a relation of connection between data lines and a test current generation circuit.

Moreover, as the relation of connection between the data lines and the test current generation circuit shown in FIG. 6, the test current generation circuit 40 may include as many current generators 42 as the number of the data lines 31.

Figure 7:
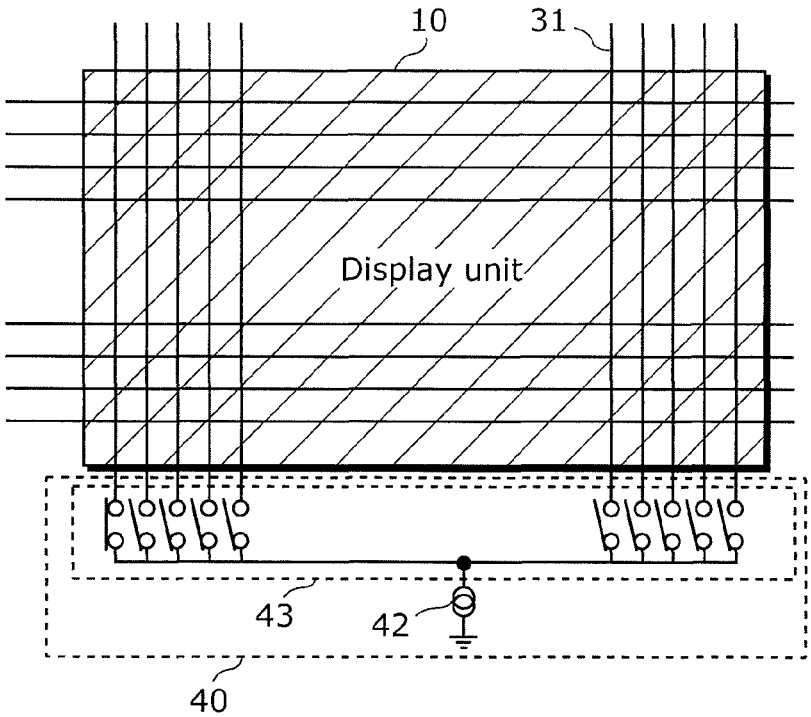
FIG. 7 is a diagram showing a relation of connection between the data lines and the test current generation circuit.

Furthermore, as the relation of connection between the data lines and the test current generation circuit shown in FIG. 7, the test current generation circuit 40 may include a fewer number of the current generators 42 than the number of the data lines 31 and multiplexers 43 that switch the data lines 31.

Figure 8:
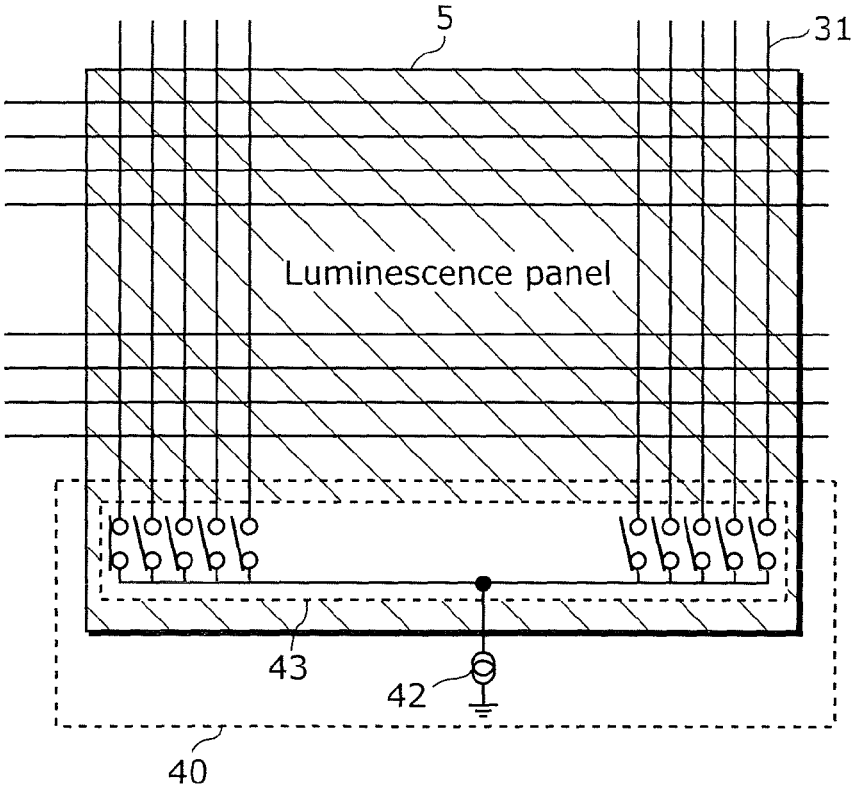
FIG. 8 is a diagram showing a relation of connection between the data lines and the test current generation circuit.

Moreover, in the case where the test current generation circuit 40 includes the fewer number of the current generators 42 than the number of the data lines 31 and the multiplexers 43 that switch the data lines 31, as the relation of connection between the data lines and the test current generation circuit shown in FIG. 8, the multiplexers 43 may be formed on a luminescence panel 5.

Further, together with the data line driving circuit 30, the voltage detection circuit 50 may be included in the data driver IC or may be provided independent of the data driver IC.

Figure 9:
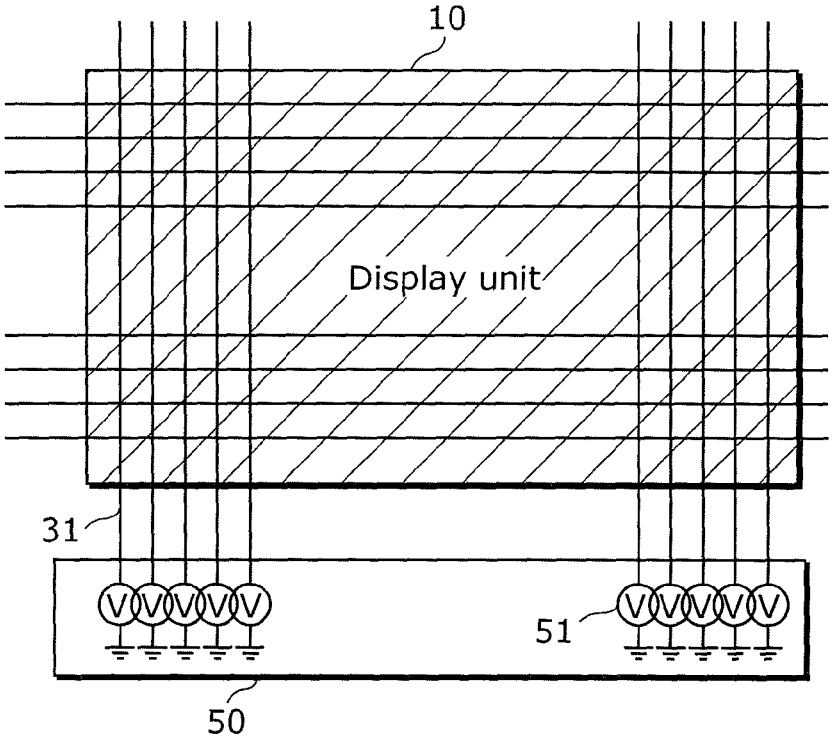
FIG. 9 is a diagram showing a relation of connection between the data lines and a voltage detection circuit.

Moreover, as the relation of connection between the data lines and the voltage detection circuit shown in FIG. 9, the voltage detection circuit 50 may include as many voltage detectors 51 as the number of the data lines 31.

Figure 10:
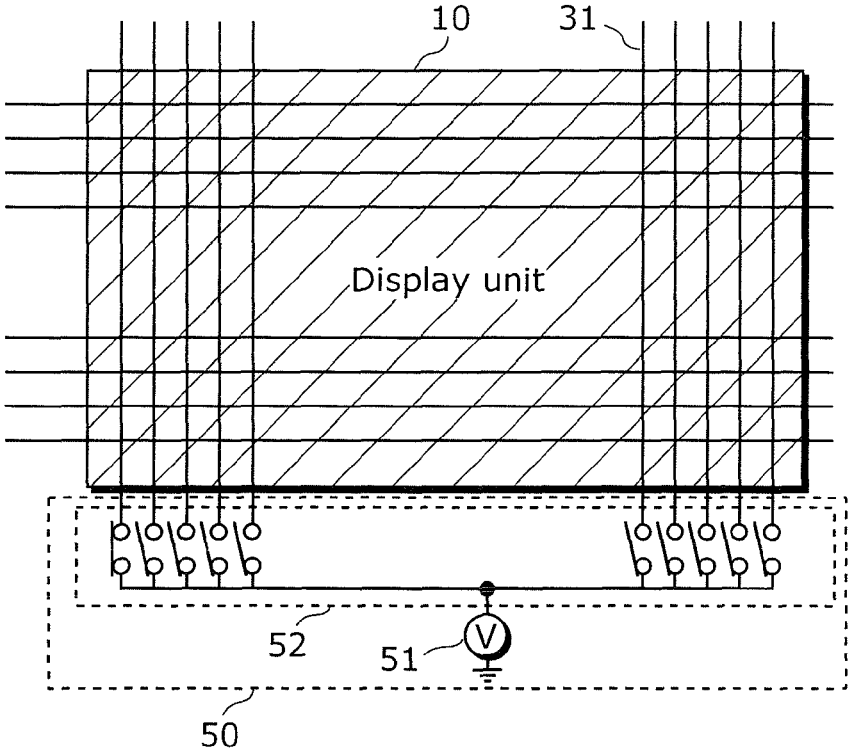
FIG. 10 is a diagram showing a relation of connection between the data lines and the voltage detection circuit.

Furthermore, as the relation of connection between the data lines and the voltage detection circuit shown in FIG. 10, the voltage detection circuit 50 may include a fewer number of the voltage detectors 51 than the number of the data lines 31 and multiplexers 52 that switch the data lines 31.

Figure 11:
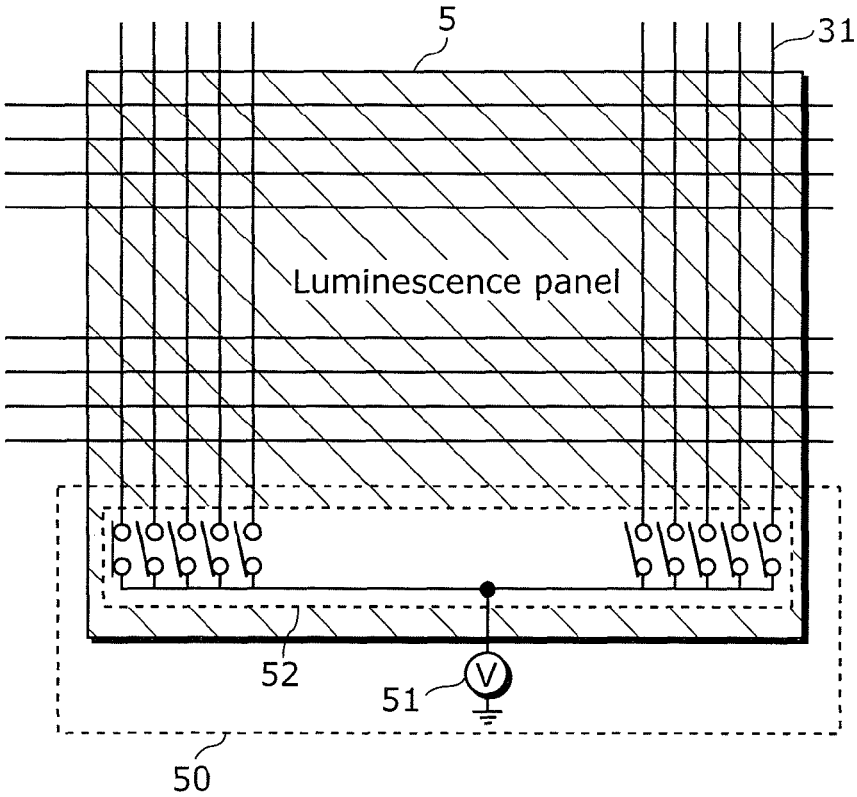
FIG. 11 is a diagram showing a relation of connection between the data lines and the voltage detection circuit.

Moreover, in the case where the voltage detection circuit 50 includes the fewer number of the current detectors 51 than the number of the data lines 31 and the multiplexers 52 that switch the data lines 31, as the relation of connection between the data lines and the voltage detection circuit shown in FIG. 11, the multiplexers 52 may be formed on the luminescence panel 5.

Figure 12:
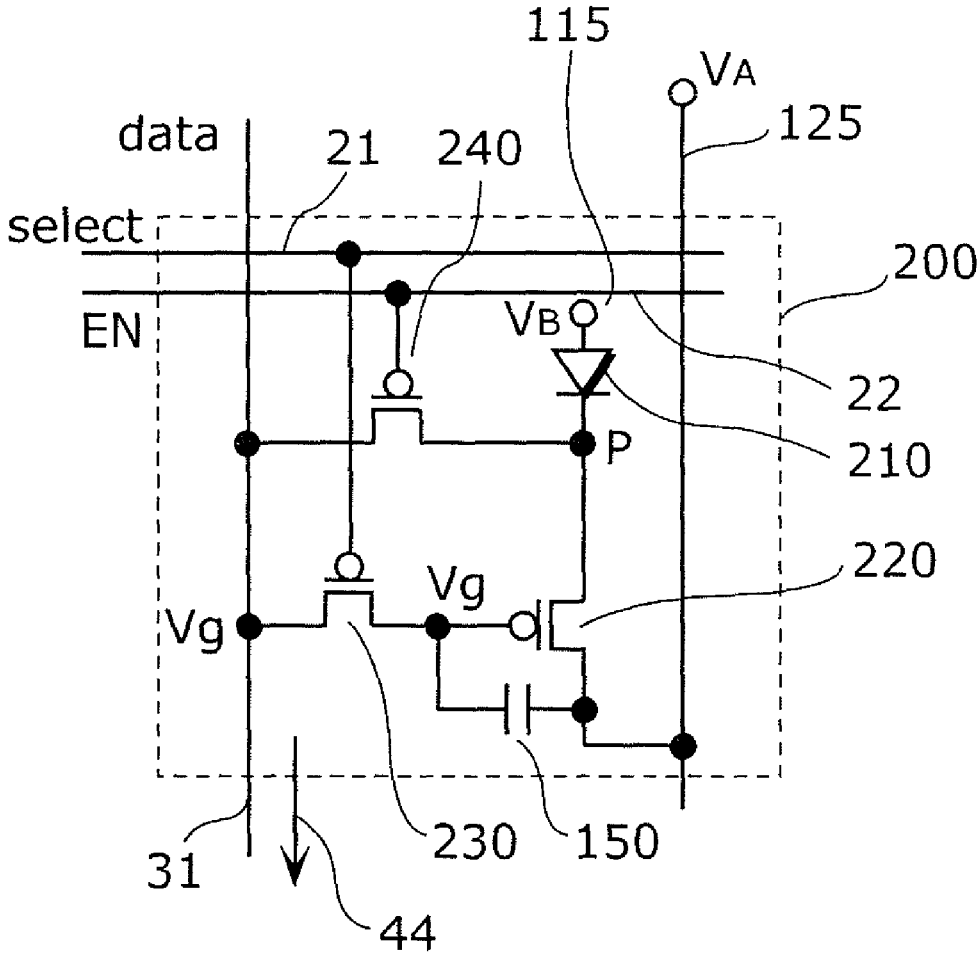
FIG. 12 is a circuit configuration diagram of a pixel unit included in the display device according to a first modification of Embodiment 1 of the present invention.

FIG. 12 is a circuit configuration diagram of a pixel unit included in the display device according to a first modification of Embodiment 1 of the present invention. A pixel unit 200 in the figure includes an organic EL element 210, a driving transistor 220, a switching transistor 230, a test transistor 240, a capacitor element 150, a common electrode 115, a power line 125, a scanning line 21, a control line 22, and a data line 31.

In comparison with the pixel unit 100 shown in FIG. 2, the pixel unit 200 shown in the figure differs, as the circuit configuration, only in that all the transistors are p-channel transistors and that a terminal of the organic EL element 210 connected to the driving transistor 220 is a cathode. The following describes only differences between a driving method of the display device including the pixel unit 200 and the driving method of the display device including the pixel unit 100 shown in FIG. 3.

In step S11 shown in FIG. 3, the voltages of the scanning line 21 and the control line 22 are changed from a high level to a low level, so as to turn on the switching transistor 230 and the test transistor 240. It is to be noted that when the characteristic of the organic EL element is detected, the switching transistor 230 may be in off-state.

In step S12 shown in FIG. 3, a test current 44 flows in a direction opposite to the flowing direction of the test current 41 shown in FIG. 2.

This makes it possible to obtain the gate voltage of the driving transistor 220 or the cathode voltage of the organic EL element 210 with respect to magnitude of the test current 44.

Figure 13:
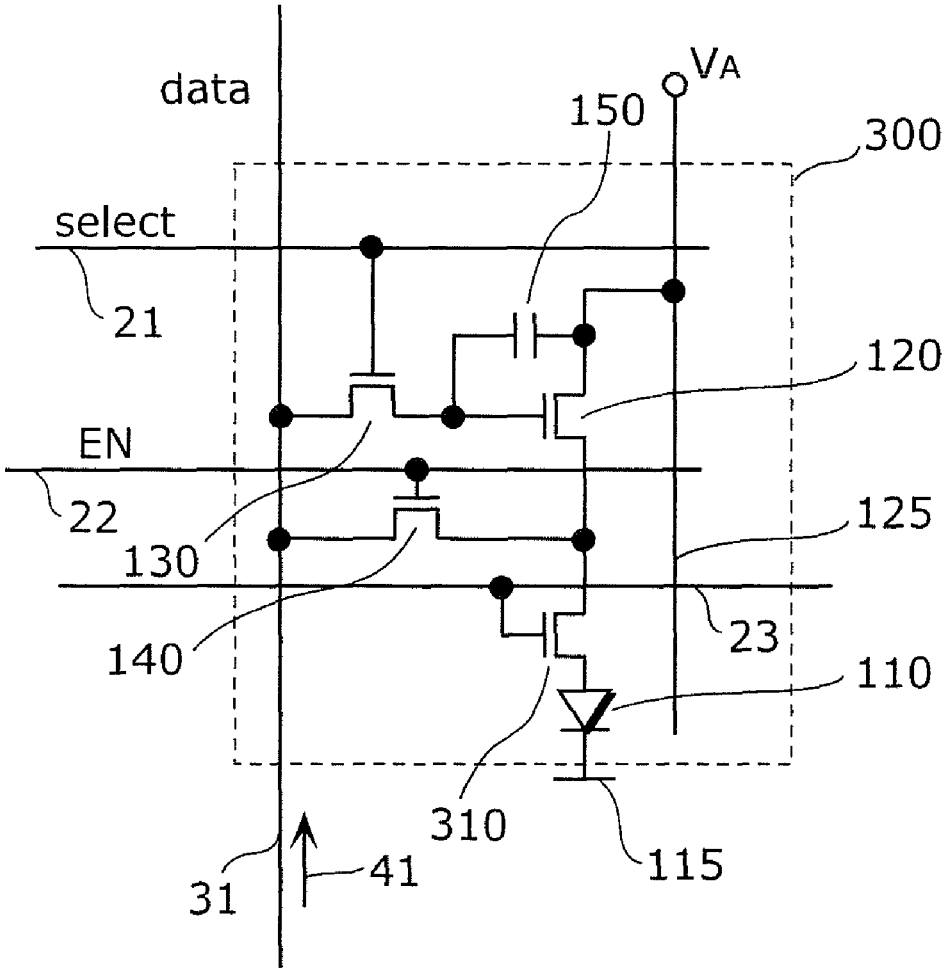
FIG. 13 is a circuit configuration diagram of a pixel unit included in the display device according to a second modification of Embodiment 1 of the present invention.

FIG. 13 is a circuit configuration diagram of a pixel unit included in the display device according to a second modification of Embodiment 1 of the present invention. A pixel unit 300 in the figure includes an organic EL element 110, a driving transistor 120, a switching transistor 130, an EL switching transistor 310, a test transistor 140, a capacitor element 150, a common electrode 115, a power line 125, a scanning line 21, a control line 22, and a data line 31.

In comparison with the pixel unit 100 shown in FIG. 2, the pixel unit 300 shown in the figure differs, as the circuit configuration, only in that the EL switching transistor 310 is inserted into the anode terminal of the organic EL element 110 and that the control line 23 for controlling on-state and off-state of the EL switching transistor 310 is connected to the gate of the EL switching transistor 310.

The EL switching transistor 310 functions as a second switching element, and controls supply and non-supply of a test current to the organic EL element 110.

The following describes only differences between a driving method of the display device including the pixel unit 300 and the driving method of the display device including the pixel unit 100 shown in FIG. 3.

In step S12 shown in FIG. 3, the control is performed so that the test current 41 flows not into the organic EL element 110 but into the driving transistor 120 by applying the reverse bias voltage to the organic EL element 110. On the other hand, in the second modification, control is performed so that the test current 41 flows not into the organic EL element 110 but into the driving transistor 120 by turning off via the control line 23 the EL switching transistor 310 connected to the anode of the organic EL element 110.

Figure 14:
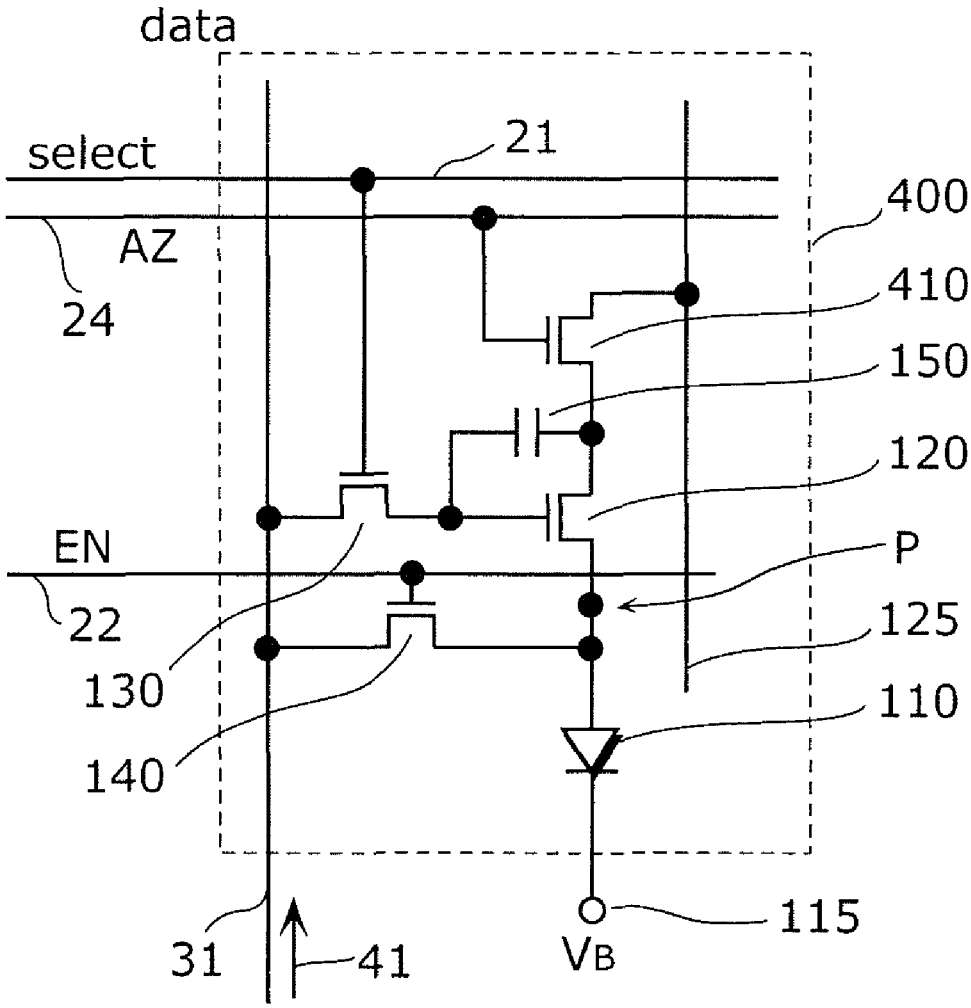
FIG. 14 is a circuit configuration diagram of a pixel unit included in the display device according to a third modification of Embodiment 1 of the present invention.

FIG. 14 is a circuit configuration diagram of a pixel unit included in the display device according to a third modification of Embodiment 1 of the present invention. A pixel unit 400 in the figure includes an organic EL element 110, a driving transistor 120, switching transistors 130 and 410, a test transistor 140, a capacitor element 150, a common electrode 115, a power line 125, a scanning line 21, control lines 22 and 24, and a data line 31.

In comparison with the pixel unit 100 shown in FIG. 2, the pixel unit 400 shown in the figure differs, as the circuit configuration, only in that the switching transistor 410 is inserted between a second terminal of the driving transistor 120 and the power line 125 and that the control line 24 for controlling on-state and off-state of the switching transistor 410 is connected to the gate of the switching transistor 410.

The switching transistor 410 functions as a third switching element, and controls supply and non-supply of a test current to the driving transistor 120.

The following describes only differences between a driving method of the display device including the pixel unit 400 and the driving method of the display device including the pixel unit 100 shown in FIG. 3.

In step S12 shown in FIG. 3, the control is performed so that the test current 41 flows not into the driving transistor 120 but into the organic EL element 110 by applying, to the power line 125, a voltage equal to or greater than the gate voltage of the driving transistor 120. On the other hand, in the third modification, control is performed so that the test current 41 flows not into the driving transistor 120 but into the organic EL element 110 by turning off via the control line 24 the switching transistor 410 connected to the second terminal of the driving transistor 120.

It is to be noted that the switching transistor 410 added in the third modification may be inserted into the first terminal of the driving transistor 120 (point P in FIG. 14).

In the above first to third modifications of Embodiment 1 of the present invention, the voltage of the data line is measured and the detection result is evaluated, and thus not only is a pixel defect in the pixel unit discovered, but also information about the characteristic variation of the driving transistor or the organic EL element and the time variation is independently obtained. The obtained characteristic parameter is stored into the memory and used in correcting the data voltage during normal operation (to be described later), and thus the luminance unevenness caused by the characteristic variation of the driving transistor or the organic EL element is suppressed.

(Embodiment 2)

A display device according to Embodiment 2 includes an active-matrix luminescence panel including pixel units, wherein each of the pixel units includes a first transistor which provides a signal current corresponding to a signal voltage provided from a selected data line; a first switching element which switches between supply and non-supply of the signal voltage to the first transistor, a luminescence element which outputs an optical signal in response to the provision of the signal current; a voltage converting unit which is provided between the first transistor and the first switching element; and one or more second switching elements which are connected so that the selected data line and a first gate terminal of the first transistor can be in short circuit condition or conduction state having a certain difference in potential and that the selected data line and a second terminal of the first transistor are in short circuit condition. In addition, the display device includes: a test current generation circuit which passes a test current to the first transistor or the luminescence element; and a voltage detection circuit which measures a voltage generated by the test current in the selected data line. Accordingly, in a circuit for which variation in a threshold value (Vth) of the first transistor is compensated, characteristics of the driving transistor and the luminescence element provided to each pixel can be independently measured with a high degree of accuracy, and thus it is possible to correct luminance unevenness caused by uneven characteristic of the driving transistor or the luminescence element.

Figure 15:
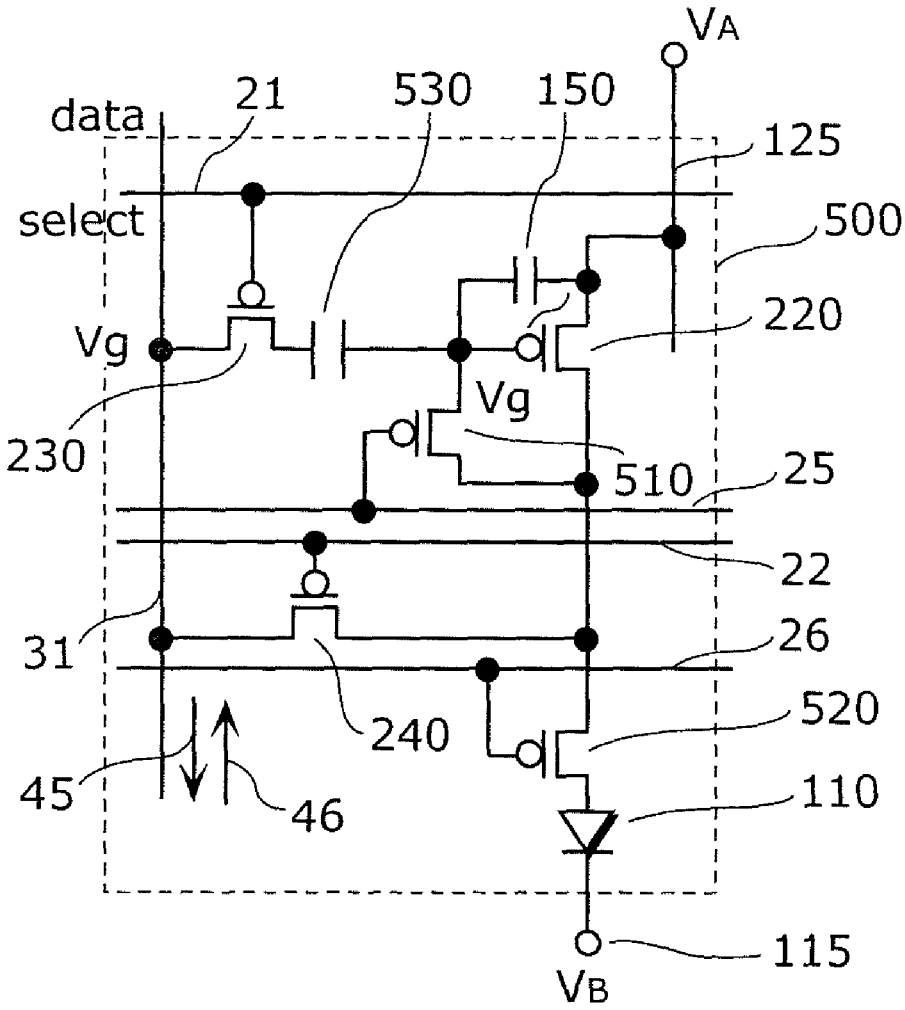
FIG. 15 is a circuit configuration diagram of a pixel unit included in a display device according to Embodiment 2 of the present invention.

FIG. 15 is a circuit configuration diagram of a pixel unit included in a display device according to Embodiment 2 of the present invention. A pixel unit 500 in the figure includes an organic EL element 110, a driving transistor 220, a switching transistor 230, an EL switching transistor 520, a test transistor 240, a threshold compensation transistor 510, a capacitor element 150, a threshold compensation capacitor element 530, a common electrode 115, a power line 125, a scanning line 21, control lines 22, 25 and 26, and a data line 31. In comparison with the pixel unit 100 included in the display device according to Embodiment 1, the pixel unit 500 in the figure differs in that the threshold compensation transistor 510 and the control line 25 which is a second control line controlling the operation of the threshold compensation transistor 510 are added, that the EL switching transistor 520 and the control line 26 which controls the operation of the EL switching transistor 520 are added to the anode terminal of the organic EL element 110, that the threshold compensation capacitor element 530 is added between the switching transistor 230 and the gate terminal of the driving transistor 220, and that all of the above transistors are p-channel transistors. Hereinafter, descriptions of similarities to the pixel unit 100 shown in FIG. 2 are omitted, and only differences from the pixel unit 100 are described.

The threshold compensation transistor 510 has one of a source and a drain connected to one of a source and a drain which is a first terminal of the driving transistor 220, and the other of the source and the drain connected to the gate of the driving transistor 220.

The pixel unit 100 controls supply of current to the organic EL element 110 with a basic circuit including two transistors (the driving transistor 120 and the switching transistor 130) and one capacitor element (the capacitor element 150), whereas the pixel unit 500 in which the threshold compensation transistor 510 and the threshold compensation capacitor element 530 are added to the above basic circuit compensates variation in threshold voltage $V_{th}$ of the driving transistor, the threshold compensation capacitor element 530 functioning as a voltage converting unit. Accordingly, the driving transistor 220 prevents variation in output signal current caused by the variation in the threshold voltage $V_{th}$.

The EL switching transistor 520 functions in the same manner as the EL switching transistor 310 included in the pixel unit 300 shown in FIG. 13, and controls supply and non-supply of the test current 41 to the organic EL element 110.

Figure 16:
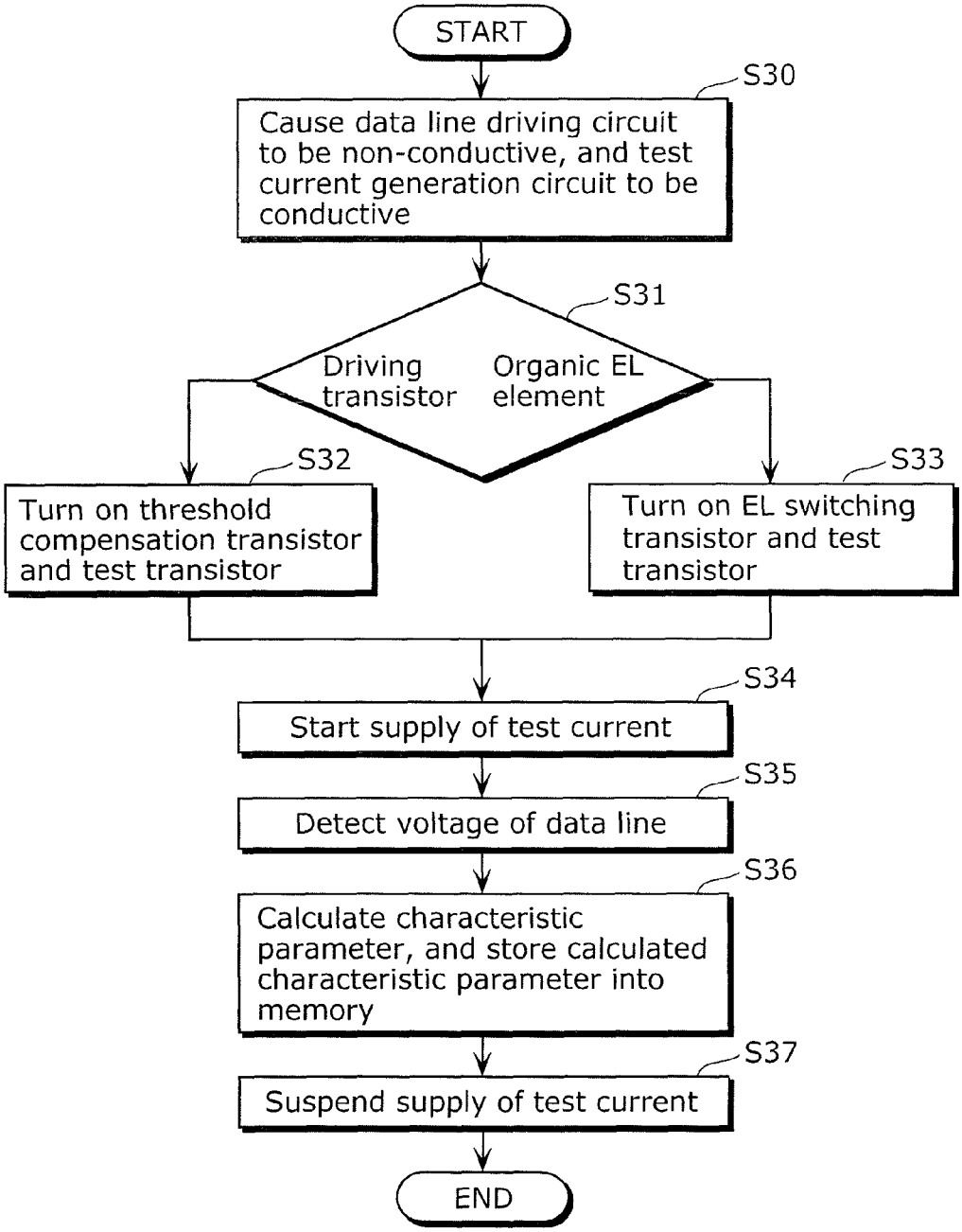
FIG. 16 is an operation flowchart of a control circuit included in the display device according to Embodiment 2 of the present invention in the case where a characteristic of a driving transistor or an organic EL element is detected.

FIG. 16 is an operation flowchart of a control circuit included in the display device according to Embodiment 2 of the present invention in the case where a characteristic of a driving transistor or an organic EL element is detected. Here, a configuration and connection of peripheral circuitry of the pixel unit 500 are the same as those of the peripheral circuitry shown in FIG. 2.

Initially, the connection between the data line driving circuit 30 and the data line 31 is in a non-conduction state, and the connection between the test current generation circuit 40 and the data line 31 is set to a conduction state (S30). The connection is realized by, for instance, turning off a switch between the data line driving circuit 30 and the data line 31 or turning on a switch between the test current generation circuit 40 and the data line 31.

Next, a case where the characteristic of the driving transistor 220 is detected or a case where the characteristic of the organic EL element 110 is detected is selected (S31).

The following describes operations when the case where the characteristic of the driving transistor 220 is detected is selected in step S31.

Figure 17:
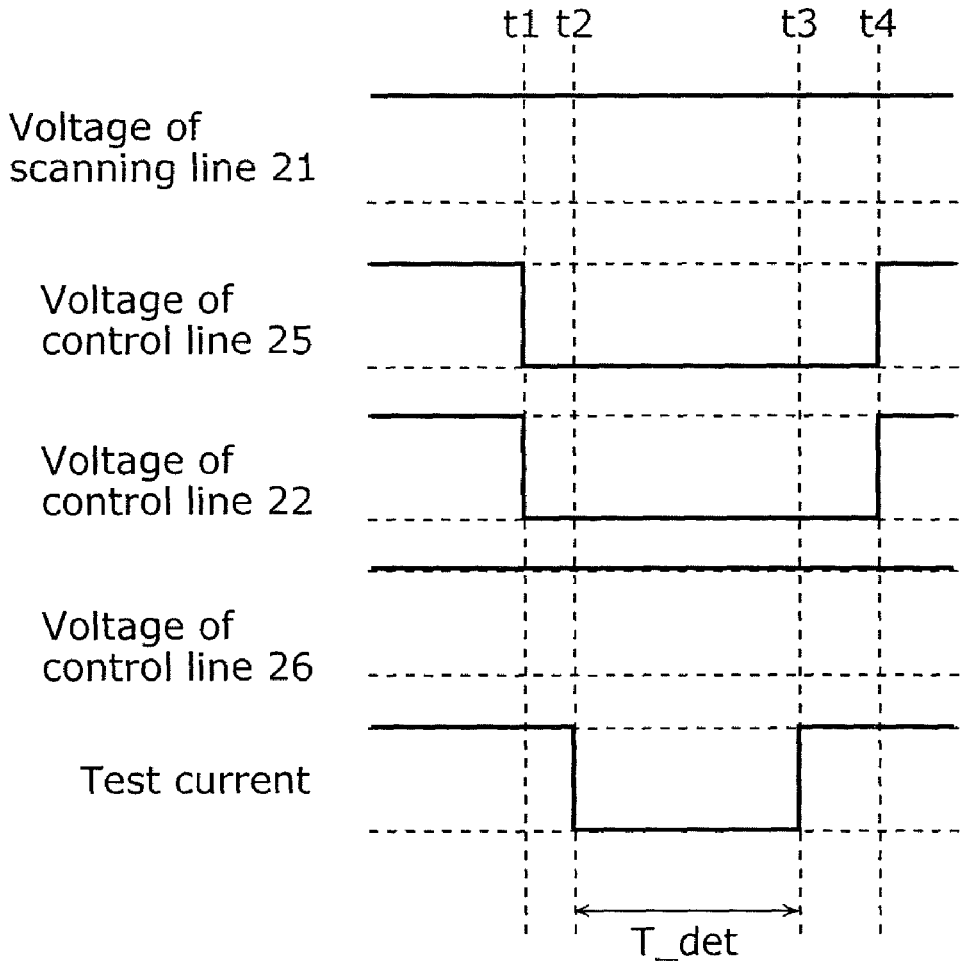
FIG. 17 is a timing diagram showing a test current supply timing in the case where the characteristic of the driving transistor is detected.

FIG. 17 is a timing diagram showing a test current supply timing in the case where the characteristic of the driving transistor is detected. In the figure, the horizontal axis indicates a time. Moreover, in the vertical direction, respective voltages of the scanning line 21, the control line 25, the control line 22, and the control line 26 and the test current are shown in this order.

At time t1 in FIG. 17, voltage levels of the control lines 25 and 22 are set to low to turn on the threshold compensation transistor 510 and the test transistor 240, respectively (S32).

The following describes operations when the case where the characteristic of the organic EL element 110 is detected is selected in step S31.

Figure 18:
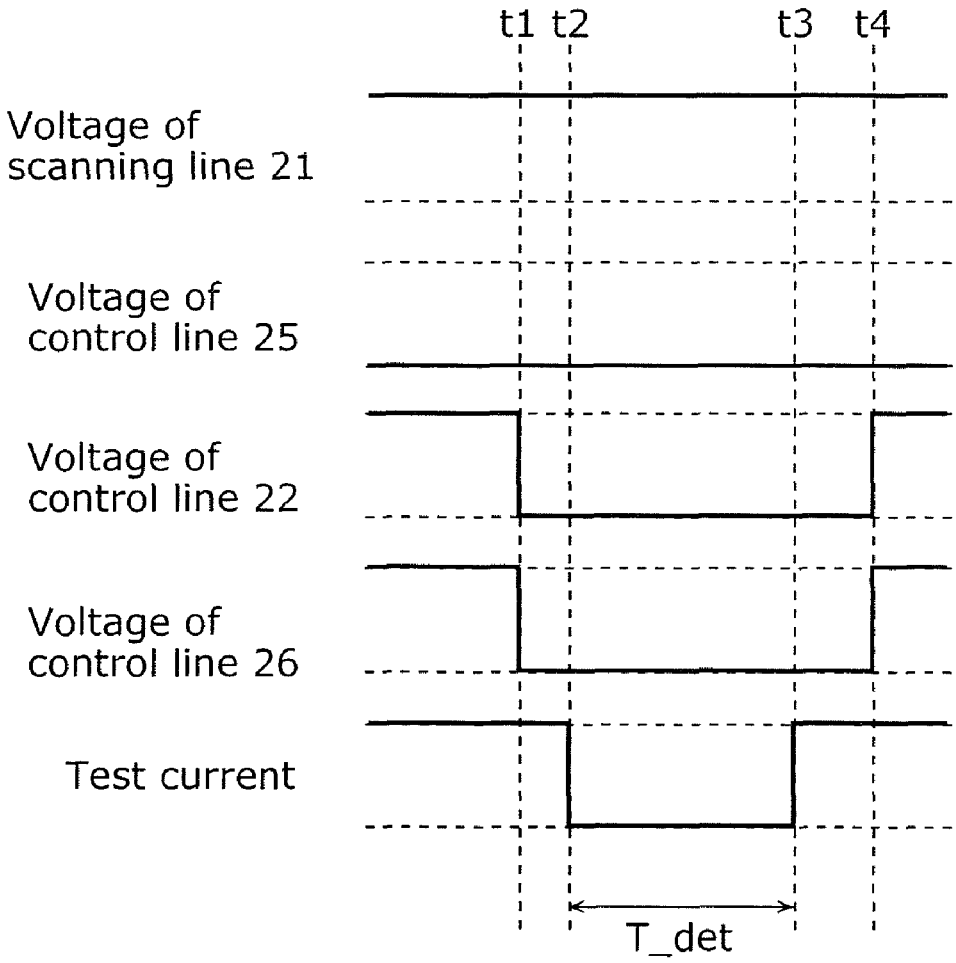
FIG. 18 is a timing diagram showing a test current supply timing in the case where the characteristic of the organic EL element is detected.

FIG. 18 is a timing diagram showing a test current supply timing in the case where the characteristic of the organic EL element is detected. In the figure, the horizontal axis indicates a time. Moreover, in the vertical direction, respective voltages of the scanning line 21, the control line 25, the control line 22, and the control line 26 and the test current are shown in this order.

At time t1 in FIG. 18, voltage levels of the control lines 22 and 26 are set to low to turn on the test transistor 240 and the EL switching transistor 520, respectively (S33).

Concerning subsequent steps, operations at the time of detecting the characteristic of the driving transistor or the organic EL element are described as common steps.

At time t2 in FIG. 17 or FIG. 18, a test current 45 is passed from the test current generation circuit 40 in a direction of arrow in FIG. 15 at the time of detecting the characteristic of the driving transistor. Alternatively, a test current 46 is passed from the test current generation circuit 40 in a direction of arrow in FIG. 15 at the time of detecting the characteristic of the organic EL element (S34).

The test current 45 at the time of detecting the characteristic of the driving transistor flows into the power line 125 via the data line 31, the test transistor 240, and the driving transistor 220. At that time, the threshold compensation transistor 510 and the test transistor 240 connect the gate terminal of the driving transistor 220 to the data line 31, and thus the voltage of the data line 31 becomes almost equal to a gate voltage of the driving transistor 220 when the test current 45 flows into the driving transistor 220.

Here, the driving transistor 220 operates in a saturation region, because the gate and drain terminals of the driving transistor 220 are connected with each other via the threshold compensation transistor 510. Furthermore, the source voltage of the driving transistor 220 is a voltage applied to the power line 125. Here, where a detected voltage is $V_{det}$, a power supply voltage applied to the source terminal of the driving transistor 220 is $V_{dd}$, and a test current is $I_{test}$, the above Equation 1 holds.

Here, as in Embodiment 1, voltages are detected by passing two types of test current $I_1$ and $I_2$ each having different magnitude, and β and $V_{th}$ are determined by solving the simultaneous equation (Equation 4) to which the test currents $I_1$ and $I_2$ and the detected voltages are applied. Alternatively, when the pixel unit 500 according to Embodiment 2 compensates characteristic variation between pixels, the pixel unit 500 can handle an initial value $V_{th}$ as a constant, because the threshold voltage $V_{th}$ of the driving transistor 220 is compensated during normal operation. Consequently, after the initial value $V_{th}$ is determined, only variable β may be determined using one type of test current I_test as below.

When it is assumed that $V_{gs}=V_{det}-V_{dd}$ in Equation 2 and the equation is solved, β is determined as follows.

[Math. 5]

$$\beta = \frac{2 \times I_test}{(V_{gs} - V_{th})^2} \quad \text{(Equation 5)}$$

Accordingly, the voltage of the data line 31 at the time of supplying the test current 45 is measured, and thus a characteristic parameter β regarding the mobility of the driving transistor 220 or the like can be calculated.

On the other hand, the test current 46 at the time of detecting the characteristic of the organic EL element does not flow into the driving transistor 220, because a voltage almost equal to or lower than a gate potential of the driving transistor 220 is applied to the power line 125. The test current 46 flows into the common electrode 115 via the data line 31, the test transistor 240, the EL switching transistor 520, and the organic EL element 110. At that time, the test transistor 240 and the EL switching transistor 520 connect the anode of the organic EL element 110 to the data line 31, and thus the voltage of the data line 31 becomes almost equal to an anode voltage of the organic EL element 110 when the test current 46 flows into the organic EL element 110.

Next, between t2 and t3 in FIG. 17 or FIG. 18, the test current 45 or the test current 46 is supplied, and the voltage detection circuit 50 detects a voltage appearing on the data line 31 (S35). This makes it possible to obtain the gate voltage of the driving transistor 220 or the anode voltage of the organic EL element 110 with respect to magnitude of the test current.

Here, where the test current 46 is $I_{EL}$ and the generated anode voltage of the organic EL element 110 is $V_{EL}$, the initial current-voltage characteristic of the organic EL element 110 which has been obtained and a deviation from ($I_{EL}$, $V_{EL}$) which is obtained now can be calculated.

Next, as stated above, the voltage value $V_{det}$ ($V_{det1}$ or $V_{det2}$) detected by the voltage detection circuit 50 or $V_{EL}$ is converted into a digital value, and the characteristic parameter calculated using the digital value and Equation 2 or 5, or the initial current-voltage characteristic is stored into the memory 80 (S36).

Next, at t3 in FIG. 17 or FIG. 18, the supply of the test current is suspended (S37).

It is to be noted that step S37 does not necessarily follow step S36, and may be performed in parallel with step S36 or after step S35 and before step S36.

With the above series of the operation steps, the voltage of the data line is measured and the detection result is evaluated in the transistor compensating the threshold voltage of the driving transistor and in the pixel unit to which the capacitor element is added, and thus not only is a pixel defect in the pixel unit discovered, but also information about the characteristic variation of the driving transistor or the organic EL element and the time variation is independently obtained. The obtained characteristic parameter is stored into the memory and used in correcting the data voltage during normal operation (to be described later), and thus the luminance unevenness caused by the characteristic variation of the driving transistor or the organic EL element or the time variation is suppressed.

The following describes a driving method of the display device during normal operation according to Embodiment 2 of the present invention. An operation flowchart of the control circuit during normal operation according to the present invention is the same as the operation flowchart of the control circuit during normal operation shown in FIG. 5. Thus, the operations of the control circuit are described with reference to FIG. 5.

Initially, the connection between the data line driving circuit 30 and the data line 31 is in a conduction state, and the connection between the test current generation circuit 40 and the data line 31 is set to a non-conduction state (S20).

Next, the test transistor 240 is turned of (S21). It is to be noted that step S21 may be performed before step S20. In addition, although the test transistor 240 is always in off-state during normal operation, step S21 may be used for black insertion at the time of driving, because the output voltage of the data line driving circuit 30 can be directly applied to the organic EL element 110 by turning on the test transistor 240 and the EL switching transistor 520.

Lastly, a signal voltage corrected using the characteristic parameter read out from the memory 80 is outputted from the data line driving circuit 30 and is written into the pixel unit 500, and thus image display is performed (S22).

As stated above, in the display device according to Embodiment 2 of the present invention which includes the transistor compensating the threshold voltage of the driving transistor and the pixel unit to which the capacitor element is added, the signal voltage is corrected through the operation of detecting the characteristic of the driving transistor or the organic EL element and the normal operation, based on the characteristic parameter obtained at the time of detecting the characteristic, and thus the luminance unevenness caused by the characteristic variation of the driving transistor or the organic EL element and the time variation is suppressed.

It is to be noted that the threshold compensation capacitor element 530 may be a voltage conversion circuit which converts the signal voltage from the data line into a voltage corresponding to the signal voltage and outputs the voltage to the gate of the driving transistor 220.

Furthermore, in the case where the threshold compensation capacitor element 530 is the voltage conversion circuit, one of the source and the drain of the threshold compensation transistor 510 may be connected not to one of the source and the drain, which is the first terminal of the driving transistor 220, but to the data line 31.

Moreover, in the case where the threshold compensation capacitor element 530 is the voltage conversion circuit, one of the source and the drain of the threshold compensation transistor 510 may be connected not to one of the source and the drain, which is the first terminal of the driving transistor 220, but to a connection point between the switching transistor 230 and the voltage conversion circuit.

Furthermore, in the case where the threshold compensation capacitor element 530 is the voltage conversion circuit, one of the source and the drain of the test transistor 240 may be connected not to the data line 31 but to the connection point between the switching transistor 230 and the voltage conversion circuit.

Moreover, in the case where the threshold compensation capacitor element 530 is the voltage conversion circuit, one of the source and the drain of the test transistor 240 may be connected not to the data line 31 but to the connection point between the switching transistor 230 and the voltage conversion circuit, and one of the source and the drain of the threshold compensation transistor 510 may be connected not to one of the source and the drain, which is the first terminal of the driving transistor 220, but to the data line 31.

Furthermore, in the case where the threshold compensation capacitor element 530 is the voltage conversion circuit, one of the source and the drain of the test transistor 240 may be connected not to the data line 31 but to the connection point between the switching transistor 230 and the voltage conversion circuit, and one of the source and the drain of the threshold compensation transistor 510 may be connected not to one of the source and the drain, which is the first terminal of the driving transistor 220, but to the connection point between the switching transistor 230 and the voltage conversion circuit.

Moreover, in the case where the threshold compensation capacitor element 530 is the voltage conversion circuit, the other of the source and the drain of the test transistor 240 may be connected not to one of the source and the drain, which is the first terminal of the driving transistor 220, but to the gate of the driving transistor 220.

It is to be noted that the operations of detecting the characteristic of the driving transistor the organic EL element in each of the pixel units have been described in Embodiments 1 and 2, but the characteristics of both of the driving transistor and the organic EL element that are included in each of the pixel units may be detected using the circuit configuration and the operations described in Embodiments 1 and 2. Specifically, in Embodiment 1, the detection of the characteristics of both of the driving transistor and the organic EL element is realized by detecting the gate voltage of the driving transistor 120 when the first test current flows and the anode voltage of the organic EL element 110 when the second current flows. The following describes an effect of detecting the characteristics of both of the driving transistor and the organic EL element in each of the pixel units.

In a case of a pixel circuit configuration in which an organic EL element is connected to a source terminal of a driving transistor, luminescence intensity is easily influenced by not only deterioration of the driving transistor but also deterioration of the organic EL element. The following describes reasons for the above.

A current flowing into the organic EL element is determined by a gate voltage with reference to the source terminal of the driving transistor. When not a power line of a constant voltage but the organic EL element is connected to the source terminal, a source voltage varies due to a characteristic of the organic EL element. A voltage when the same current is passed in the organic EL element rises due to time degradation. In other words, there is a tendency of increasing resistance in the organic EL element. As a result, for instance, in the pixel unit 100 described in Embodiment 1, a source voltage of the driving transistor 120 rises due to an increase in resistance of the organic EL element. Thus, even when the same data voltage is applied to the gate terminal of the driving transistor 120, a flowing current is reduced.

Therefore, even when only the deterioration of the driving transistor is detected and gate terminal is determined for passing a desired current, an appropriate correction data voltage cannot be derived for passing the desired current, because it is not clear how the source voltage varies due to the deterioration of the organic EL element.

Here, when the characteristic of the organic EL element is detected simultaneously, a source voltage reflecting the characteristic of the organic EL element can be determined, and thus it is possible to derive the appropriate correction data voltage.

Consequently, in the case where both of the organic EL element and the driving transistor undergo the time degradation, the detection of the characteristics of the both makes it possible to control a data voltage for achieving desired luminescence intensity more appropriately.

Though only the deterioration has been described above, for similar reasons, it is effective to detect the characteristics of both of the organic EL element and the driving transistor even at an initial stage such as before shipment. This makes it possible to recognize an appropriate data voltage, which cannot be derived by only the detection of the characteristic of the driving transistor, before shipment.

According to the present invention, like the pixel unit 100, only adding one test transistor to the basic pixel circuit makes it possible to detect the characteristics of both of the driving transistor and the organic EL element, and derive the above-described highly accurate correction data voltage.

(Embodiment 3)

An electronic device according to Embodiment 3 includes an active-matrix panel substrate including pixel units prior to formation of a luminescence element, wherein each of the pixel units includes: a first transistor which provides a signal current corresponding to a signal voltage provided from a selected data line; a first switching element which switches between supply and non-supply of the signal voltage to the first transistor; and a second switching element which is connected so that the selected data line and a second terminal of the first transistor can be in short circuit condition. In addition, the electronic device further includes: a test current generation circuit which passes a test current to the first transistor; and a voltage detection circuit which measures a voltage generated by the test current in the selected data line. Accordingly, a characteristic of the driving transistor provided in each pixel can be measured with a high degree of accuracy, and thus it is possible to correct luminance unevenness caused by an uneven characteristic of the driving transistor on the luminescence panel in which the luminescence element is formed.

Figure 19:
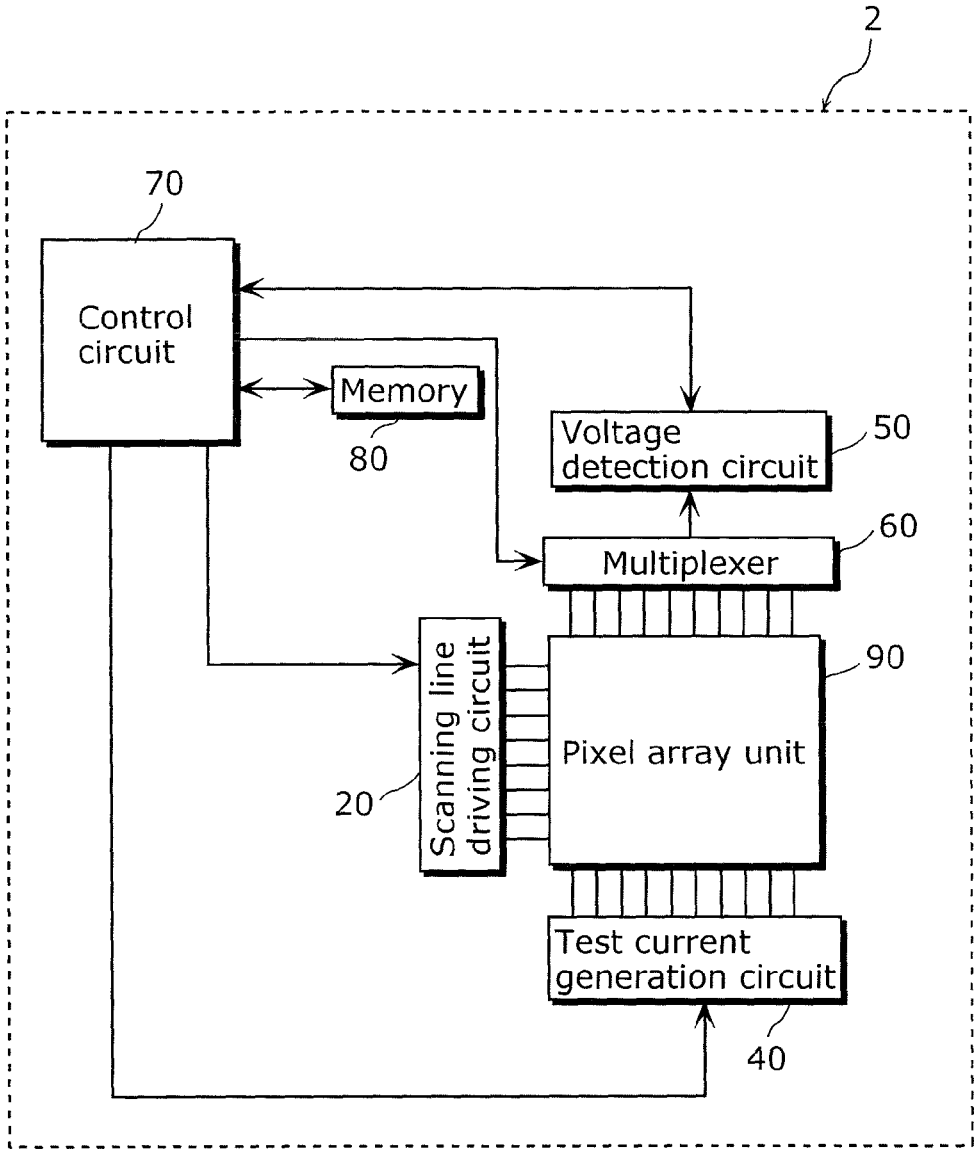
FIG. 19 is a block diagram showing an electrical configuration of an electronic device according to Embodiment 3 of the present invention.

FIG. 19 is a block diagram showing an electrical configuration of an electronic device according to Embodiment 3 of the present invention. An electronic device 2 in the figure includes a scanning line driving circuit 20, a test current generation circuit 40, a voltage detection circuit 50, a multiplexer 60, a control circuit 70, a memory 80, and a pixel array unit 90.

The electronic device shown in FIG. 19 is still at one of stages of forming the display device which is shown in FIG. 1 and includes the luminescence panel. In comparison with the display device according to Embodiment 1 and shown in FIG. 1, the electronic device according to Embodiment 3 and shown in the figure differs, as a configuration, in that the pixel array unit 90 is provided instead of the display unit and that the data line driving circuit 30 is not provided.

The pixel array unit includes pixel units.

Figure 20:
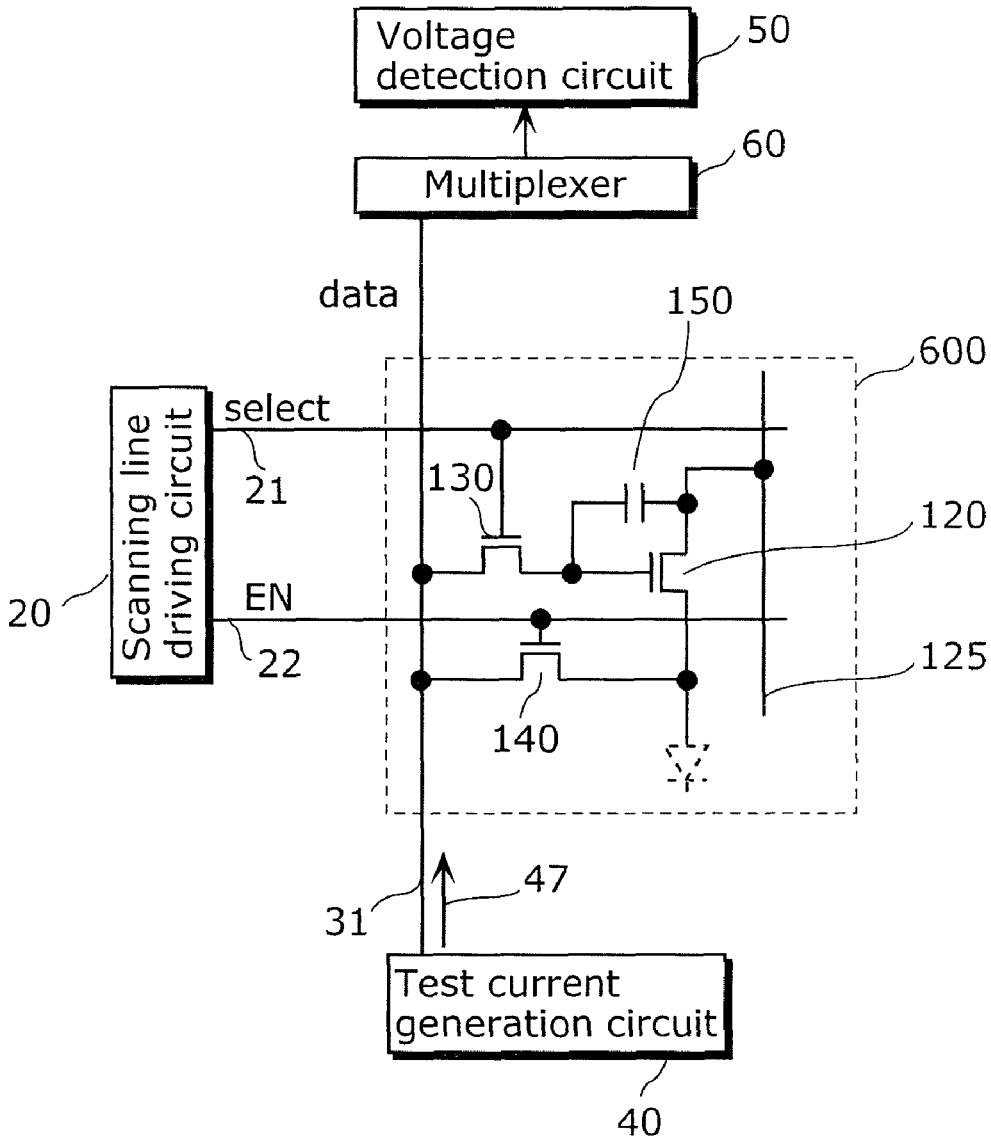
FIG. 20 is a diagram showing a circuit configuration of one of pixel units included in a pixel array unit and a connection between the pixel unit and peripheral circuitry thereof.

FIG. 20 is a diagram showing a circuit configuration of one of pixel units included in the pixel array unit and a connection between the pixel unit and peripheral circuitry thereof. A pixel unit 600 in the figure includes a driving transistor 120, a switching transistor 130, a test transistor 140, a capacitor element 150, a power line 125, a scanning line 21, a control line 22, and a data line 31. In addition, the peripheral circuitry includes the scanning line driving circuit 20, the test current generation circuit 40, the voltage detection circuit 50, and the multiplexer 60.

In comparison with the pixel unit 100 shown in FIG. 2, the pixel unit 600 shown in FIG. 20 differs, as a circuit configuration, only in that the organic EL element 110 is not provided. The pixel unit 600 is at a stage prior to the formation of the organic EL element 110, and the pixel unit 100 is created by forming the organic EL element 110 to the pixel unit 600. Hereinafter, descriptions of the elements shown in FIGS. 19 and 20 that are the same as those shown in FIGS. 1 and 2 are omitted, and only differences between them are described.

The test current generation circuit 40 is connected to the data line 31, and provides a test current 47 for detecting a characteristic of the driving transistor 120.

The voltage detection circuit 50 is connected to the data line 31 via the multiplexer 60, and detects a voltage of the data line 31 while the test current generation circuit 40 is providing the test current 47.

The control circuit 70 controls the scanning line driving circuit 20, the test current generation circuit 40, the multiplexer 60, the voltage detection circuit 50, and the memory 80, converts the voltage value detected by the voltage detection circuit 50 into a digital value, and writes, into the memory 80, a characteristic parameter obtained through a calculation.

The following describes the circuit configuration of the pixel unit 600.

The driving transistor 120 has a gate connected to the data line 31 via the switching transistor 130, one of a source and a drain, which is a first terminal, connected to an anode of an organic EL element to be formed, and the other of the source and the drain, which is a second terminal, connected to the power line 125.

The test transistor 140 has a gate connected to the control line 22, a source connected to the anode of the organic EL element to be formed, and a drain connected to the data line 31.

The following describes a driving method of the electronic device according to Embodiment 3 of the present invention. The driving method makes it possible to detect the characteristic of the driving transistor 120 before the formation of luminescence element.

The driving method can be also described with reference to the operation flowchart shown in FIG. 3 and the timing diagram showing the test current supply timing shown in FIG. 4.

Initially, the connection between the test current generation circuit 40 and the data line 31 is set to a conduction state (S10).

Next, at t1 in FIG. 4, voltage levels of the scanning line 21 and the control line 22 are set to high to turn on the switching transistor 130 and the test transistor 140, respectively (S11).

Next, at t2 in FIG. 4, the test current generation circuit 40 supplies the test current 47 in a direction of arrow shown in FIG. 20 (S12).

In step S12, the test current 47 flows into the power line 125 via the data line 31, the test transistor 140, and the driving transistor 120. At that time, the voltage of the data line 31 becomes almost equal to the gate voltage of the driving transistor 120 when the test current 47 flows into the driving transistor 120.

Next, between t2 and t3 in FIG. 4, the test current 47 is supplied, and the voltage detection circuit 50 detects a voltage appearing on the data line 31 (S13). This makes it possible to obtain the gate voltage of the driving transistor 120 with respect to magnitude of the test current 47.

Next, the voltage value detected by the voltage detection circuit 50 is converted into a digital value, and a calculated characteristic parameter is stored into the memory 80 (S14). The characteristic parameter is calculated using Equations 2 to 4 as in Embodiment 1.

Lastly, at t3 in FIG. 4, the supply of the test current 47 is suspended (S15).

It is to be noted that step S15 does not necessarily follow step S14, and may be performed in parallel with step S14 or after step S13 and before step S14.

With the above series of the operation steps, the voltage of the data line is measured and the detection result is evaluated, and thus not only is a pixel defect in the pixel unit discovered, but also information about the characteristic variation of the driving transistor is obtained. The obtained characteristic parameter is stored into the memory and used in correcting the data voltage during normal operation of the luminescence panel after the formation of luminescence element, and thus the luminance unevenness caused by the characteristic variation of the driving transistor is suppressed.

It is to be noted that although the voltage detection circuit 50 and the test current generation circuit 40 each are connected to a corresponding one of the ends of the data line 31 with the pixel unit being sandwiched therebetween in FIG. 20, the voltage detection circuit 50 and the test current generation circuit 40 may be connected to the same end of the data line 31 with respect to the pixel unit.

Furthermore, the test current generation circuit 40 may include as many current generators as the number of the data lines 31.

Moreover, the test current generation circuit 40 may include a fewer number of the current generators than the number of the data lines 31 and multiplexers that switch the data lines 31.

Furthermore, in the case where the test current generation circuit 40 includes the fewer number of the =rent generators than the number of the data lines 31 and the multiplexers that switch the data lines 31, the multiplexers may be formed above a substrate for panel.

Moreover, the voltage detection circuit 50 may include as many voltage detectors as the number of the data lines 31.

Furthermore, the voltage detection circuit 50 may include a fewer number of the voltage detectors than the number of the data lines 31 and the multiplexers that switch the data lines 31.

Moreover, in the case where the voltage detection circuit 50 includes the fewer number of the voltage detectors than the number of the data lines 31 and the multiplexers that switch the data lines 31, the multiplexers may be formed above the substrate for panel.

As described above, the display device in the present invention includes an active-matrix luminescence panel including pixel units and data lines for determining luminescence of the pixel units, wherein each of the pixel units includes: a driving transistor, a switching transistor, and a luminescence element, and the display device includes: a first circuit path forming unit which forms a first circuit path so that a first test current provided from the one of the data lines is passed between a source and a drain of the driving transistor or a second test current provided from the one of the data lines is passed to the luminescence element; a second circuit path forming unit which forms a second circuit path so that a voltage or an other voltage of one of an anode and a cathode of the luminescence element is generated in the one of the data lines, the voltage corresponding to a gate voltage of the driving transistor being generated by the first test current, and the other voltage being generated by the second test current; and a voltage detection unit which detects the voltage and the other voltage in the one of the data lines via the second circuit path. Accordingly, it is possible to independently obtain characteristic information about variation of the driving transistor or the luminescence element. Moreover, in comparison to a conventional measuring method of detecting a minute current by providing a voltage, highly accurate measurement is achieved, because the test current flows into the driving transistor or the luminescence element and a voltage of the data line at the time of the flow of the test current is measured. Further, luminance unevenness caused by an uneven characteristic of the driving transistor or the luminescence element can be reduced by using the obtained characteristic information to correct the data voltage during normal operation.

The electronic device in the present invention includes a substrate for luminescence panel which includes data lines and pixel units prior to formation of a luminescence element, wherein each of the pixel units includes: a driving transistor; and a switching transistor, and the electronic device includes: a first circuit path forming unit which forms a first circuit path so that a test current provided from the one of the data lines is passed between a source and a drain of the driving transistor; a second circuit path forming unit which forms a second circuit path so that a voltage is generated in the one of the data lines, the voltage corresponding to a gate voltage of the driving transistor being generated by the test current; and a voltage detection unit which detects, in the one of the data lines, the voltage corresponding to the gate voltage of the driving transistor being generated by the test current. Accordingly, it is possible to obtain characteristic information about variation of the driving transistor. Moreover, in comparison to the conventional measuring method of detecting the minute current by providing the voltage, the highly accurate measurement is achieved, because the test current flows into the driving transistor and the voltage of the data line at the time of the flow of the test current is measured. Further, the luminance unevenness caused by the uneven characteristic of the driving transistor can be reduced by using the obtained characteristic information to correct the data voltage during normal operation.

It is to be noted that the electronic device of the present invention is not limited to the above present embodiment. The present invention includes other embodiments realized by combining any elements in Embodiment 1 or 3 and the modifications thereof, various modifications conceived by a person with an ordinary skill in the art within the scope of Embodiment 1 or 3 and the modifications thereof, and various apparatuses including the electronic device of the present invention.

For example, insertion of the switching transistor 410 included in the pixel unit 400 into the pixel unit 300 makes it possible to control the test current 41 of the pixel unit 300 by turning on or off the EL switching transistor 310 and the switching transistor 410, the pixel unit 300 indicating the second modification of Embodiment 1 of the present invention shown in FIG. 13, and the pixel unit 400 indicating the third modification of Embodiment 1 of the present invention shown in FIG. 14.

Moreover, for instance, application of an other circuit configuration, that is, an electronic device including a substrate for panel having pixel units prior to the formation of the organic EL element 110 in each of the pixels, in the same manner as the electronic device according to Embodiment 3 of the present invention shown in FIG. 19, produces the same effect as the electronic device according to Embodiment 3, the other circuit configuration being obtained by deleting the organic EL element 110 from the circuit configuration of each of the pixel units described in Embodiment 1, the modifications thereof, and Embodiment 2.

Furthermore, although, in the embodiments of the present invention, the foregoing descriptions are based on an assumption that transistors having each of functions of the driving transistor, the switching transistor, the test transistor, and the EL switching transistor are field effect transistors (FETs)

having a gate, a source, and a drain, bipolar transistors having a base, a collector, and an emitter may be used as the transistors. In this case also, the objectives of the present invention are realized, and the same effects are produced.

Figure 21:
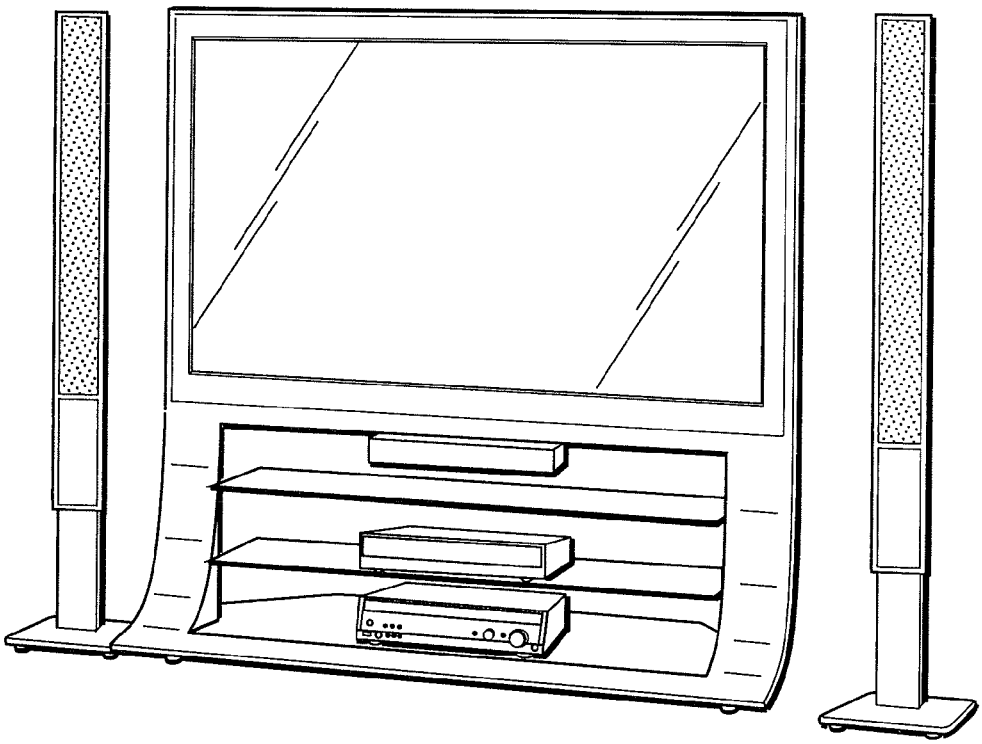
FIG. 21 is an external view of a dun fiat TV including the display device of the present invention.

The display device of the present invention is included in, for example, in a thin flat TV shown in FIG. 21. With the display device of the present invention, the thin flat TV including a display for which luminance unevenness is suppressed is realized.

INDUSTRIAL APPLICABILITY

The present invention is useful for especially organic EL flat panel displays including a display device, and suitable to be applied as a display device of a display for which evenness in image quality is required and as a driving method thereof.

What is claimed is:

1. An electronic device including a substrate for a luminescence panel that includes data lines and pixels in which a luminescence element can be formed, wherein each of the pixels includes:

a driving transistor that has a gate, a source, and a drain, and converts a signal voltage supplied from one of the data lines into a signal current; and a first switch that is provided between the one of the data lines and the gate of the driving transistor, the electronic device comprises:

a first circuit path former configured to flow a test current from the one of the data lines through the source and the drain of the driving transistor;

a second circuit path former configured to generate a voltage in the one of the data lines, the voltage corresponding to a gate voltage of the driving transistor generated by the test current; and a voltage detector configured to detect, in the one of the data lines, the voltage corresponding to the gate voltage of the driving transistor generated by the test current.

2. The electronic device according to claim 1, further comprising:

scanning lines, each of which transmits a control signal;

first control lines;

one of the source and the drain of the driving transistor being connected to one of an anode and a cathode of the luminescence element;

a first power source connected to the other of the source and the drain of the driving transistor; and a second power source connected to the other of the anode and the cathode of the luminescence element, wherein the driving transistor provides, from the one of the source and the drain of the driving transistor, a current corresponding to a potential difference between the gate and the source of the driving transistor, the first switch is a switching transistor that has a gate connected to one of the scanning lines, one of a source and a drain connected to the one of the data lines, and the other of the source and the drain connected to the gate of the driving transistor, the first circuit path former includes a test current generator that supplies the test current to the one of the data lines, a second switch that is a switching transistor that has a gate connected to one of the first control lines, one of a source and a drain connected to the one of the data lines, and the other of the source and the drain connected to a connection point between the one of the source and the drain of the driving transistor and the one of the anode and the cathode of the luminescence element, and the second circuit path former includes the first switch and the second switch.

3. The electronic device according to claim 2, wherein the test current generator is configured to pass the test current to the driving transistor, with a bias voltage value of the first power source and a bias voltage value of the second power source changing synchronously, when the first switch and the second switch are switched ON.

4. The electronic device according to claim 2, wherein the test current generator includes at least one current generator that generates the test current, and a multiplexer which is provided between the at least one current generator and the data lines and causes at least a selected one of the data lines and one of the at least one current generator to be conductive, and a quantity of the at least one current generator is fewer than a quantity of the data lines.

5. The electronic device according to claim 1, further comprising:

scanning lines each of which transmits a control signal;

one of the source and the drain of the driving transistor being connected to one of an anode and a cathode of the luminescence element;

a first power source connected to the other of the source and the drain of the driving transistor; and a second power source connected to the other of the anode and the cathode of the luminescence element, wherein the driving transistor provides, from the one of the source and the drain of the driving transistor, a current corresponding to a potential difference between the gate and the source of the driving transistor, the first switch is a switching transistor that has a gate connected to one of the scanning lines, one of a source and a drain connected to the one of the data lines, and the other of the source and the drain connected to the gate of the driving transistor, the first circuit path former includes a test current generator that supplies the test current to the one of the data lines, and each of the pixels is further provided between the gate of the driving transistor and the other of the source and the drain of the first switch, and includes a voltage converter that provides, to the gate of the driving transistor, a voltage corresponding to the signal voltage.

6. The electronic device according to claim 1, wherein the voltage detector includes at least one voltage detector that measures, in the one of the data lines, one of the voltage; and a multiplexer that is provided between the at least one voltage detector and the data lines and causes at least a selected one of the data lines and one of the at least one voltage detector to be conductive, and a quantity of the at least one voltage detector is less than a quantity of the data lines.

7. The electronic device according to claim 6, wherein the multiplexer is positioned above the active-matrix luminescence panel.

8. A method of driving an electronic device including a substrate for an active-matrix luminescence panel that includes data lines and pixels in which a luminescence element can be formed, each of the pixels including:

a driving transistor that has a gate, a source, and a drain, and converts a signal voltage supplied from one of the data lines into a signal current; and a first switch that is provided between the one of the data lines and the gate of the driving transistor, the driving method comprising:

flowing, from a test current generator via the one of the data lines, a test current between the source and the drain of the driving transistor; and detecting, with a voltage detection circuit that is connected to the one of the data lines, a voltage corresponding to a gate voltage of the driving transistor generated by the test current.

9. The method according to claim 8, wherein one of the source and the drain of the driving transistor being connected to one of an anode and a cathode of the luminescence element;

wherein flowing the test current includes:

switching ON the first switch; and setting the other of the source and the drain of the driving transistor to be in a forward-bias state and the other of the anode and the cathode of the luminescence element to be in a reverse-bias state after switching ON the first switch, whereby the test current is passed through the driving transistor and not through the luminescence element.

10. The method according to claim 8, further comprising causing a first connection between a data driving circuit and the one of the data lines to be non-conductive and a second connection between a test current generator and the one of the data lines to be conductive, prior to the detecting.

11. The method according to claim 8, comprising:

storing, in a memory, a first present characteristic parameter of the driving transistor calculated from the detected gate voltage of the driving transistor after detecting the voltage;

causing a first connection between a data driving circuit and the one of the data lines to be conductive and a second connection between the test current generator and the one of the data lines to be non-conductive after detecting the voltage; and outputting, to the data driving circuit, a first signal corrected using the first present characteristic parameter of the driving transistor read out from the memory, and supplying, to each of the pixels, a first corrected signal voltage corrected by the data driving circuit after causing the first connection between the data driving circuit and the one of the data lines to be conductive and the second connection between the test current generator and the one of the data lines to be non-conductive.

* * * * *